US009170536B2

(12) United States Patent
Yoshikawa et al.

(10) Patent No.: US 9,170,536 B2
(45) Date of Patent: Oct. 27, 2015

(54) FIXING DEVICE HAVING PRESSURE RELEASE MEMBER SUPPORTED RECIPROCABLY, AND IMAGE FORMING APPARATUS EQUIPPED THEREWITH

(71) Applicant: Sharp Kabushiki Kaisha, Osaka (JP)

(72) Inventors: Kouta Yoshikawa, Osaka (JP); Masaya Asakawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 2 days.

(21) Appl. No.: 14/163,044

(22) Filed: Jan. 24, 2014

(65) Prior Publication Data

US 2014/0294442 A1 Oct. 2, 2014

(30) Foreign Application Priority Data

Mar. 28, 2013 (JP) ..... 2013-068758

(51) Int. Cl.
*G03G 15/20* (2006.01)

(52) U.S. Cl.
CPC ..... *G03G 15/2064* (2013.01); *G03G 15/2032* (2013.01)

(58) Field of Classification Search
CPC ..... G03G 15/2064; G03G 15/2032
USPC ..... 399/122
See application file for complete search history.

(56) References Cited

U.S. PATENT DOCUMENTS 4,717,937 A * 1/1988 Fukunaga ..... 399/122
5,956,547 A * 9/1999 Kamei et al. ..... 399/122
7,668,494 B2 * 2/2010 Kubo et al. ..... 399/328
7,684,727 B2 * 3/2010 Yamanaka et al. ..... 399/110
7,840,161 B2 * 11/2010 Namisaki et al. ..... 399/122
8,041,237 B2 * 10/2011 Yamanaka et al. ..... 399/33
8,099,034 B2 * 1/2012 Tsukamoto et al. ..... 399/328
8,280,289 B2 * 10/2012 Yamanaka et al. ..... 399/323
8,364,066 B2 * 1/2013 Nakamura et al. ..... 399/328
2015/0110524 A1 * 4/2015 Sato et al. ..... 399/122

FOREIGN PATENT DOCUMENTS

JP 2001-318555 11/2001
JP 2003-223075 8/2003
JP 2008-151965 7/2008
JP 2011-175296 9/2011

* cited by examiner

*Primary Examiner* — Billy Lactaoen
*Assistant Examiner* — Arlene Heredia Ocasio
(74) *Attorney, Agent, or Firm* — Renner, Otto, Boisselle & Sklar, LLP

(57) ABSTRACT

A fixing device is configured to move the pressure release member in predetermined movement directions relative to the support member such that the biasing member can function. The support member has a first retaining part. The pressure release member has a retention element to be held in the first retaining part of the support member. When the retention element is held in the first retaining part of the support member, the pressure release member is configured to apply a biasing force of the biasing member to the support member and thereby to cause the second fixing member to be pressed against the first fixing member. When the retention element is released from the first retaining part of the support member, the pressure release member is configured to stay at a release position in the movement directions at which position the biasing member ceases to apply the biasing force to the support member, and thereby to release the pressure contact state where the second fixing member is pressed against the first fixing member.

12 Claims, 15 Drawing Sheets

FIXING DEVICE HAVING PRESSURE RELEASE MEMBER SUPPORTED RECIPROCABLY, AND IMAGE FORMING APPARATUS EQUIPPED THEREWITH

CROSS REFERENCE TO RELATED APPLICATIONS

The present application claims priority under 35 U.S.C. §119(a) to Japanese Patent Application No. 2013-068758, filed Mar. 28, 2013. The contents of this application are incorporated herein by reference in its entirety.

BACKGROUND OF THE INVENTION

The present invention relates to a fixing device applicable to an electrophotographic image forming apparatus such as a copying machine and a printer, and also relates to an image forming apparatus.

An electrophotographic image forming apparatus such as a copying machine and a printer may employ a pressure release member which presses a second fixing member (e.g. a pressure roller) against a first fixing member (e.g. a rotational fixing member such as a fixing roller and a fixing belt) by a biasing member with a predetermined pressing force, and which releases this pressure contact state where the second fixing member is pressed against the first fixing member with a predetermined pressing force.

As an example of the pressure release member, a fixing device disclosed in JP 2008-151965 A employs a cam having a large-diameter part and a small-diameter part. By utilizing the large-diameter part and the small-diameter part, this cam switches between a pressure contact state where a fixing roller (a first fixing member) and a pressure roller (a second fixing member) are pressed against each other and a released state where the pressure contact is released.

As another example of the pressure release member, a fixing device disclosed in JP 2003-223075 A employs a cam which abuts an end of a roller shaft of a pressure roller (a second fixing member) and which displaces the pressure roller in a direction away from a fixing roller (a first fixing member) against a biasing force of a spring.

As yet another example of the pressure release member, a fixing device disclosed in JP 2001-318555 A employs a cam by which a downward rotational movement of a release lever around a rotational shaft is converted into an upward rotational movement of a pressure lever around a first rotational shaft. By this converting action, the cam releases a pressure state where a pressure roller (a second fixing member) is pressed against a heating roller (a first fixing member).

In these conventional fixing devices, cams are used as the pressure release members for releasing the pressure contact state where the second fixing members are pressed against the first fixing members. However, this configuration requires a number of components for operating the pressure release members, and further requires a greater space and higher costs for such components.

SUMMARY OF THE INVENTION

An object of the present invention is to provide a fixing device which requires a fewer number of components for operating a pressure release member and thereby reduces an installation space and costs for the fixing device. Another object of the present invention is to provide an image forming apparatus equipped with this fixing device.

In order to achieve these objects, the present invention provides a fixing device including a first fixing member, a second fixing member opposed to the first fixing member, a support member which supports the second fixing member such that the second fixing member can approach and separate from the first fixing member, a biasing member which biases the support member such that the second fixing member is pressed against the first fixing member, and a pressure release member which releases a pressure contact state where the second fixing member is pressed against the first fixing member. The fixing device is configured to move the pressure release member in predetermined movement directions relative to the support member such that the biasing member can function, the movement directions being set in advance. The support member includes a first retaining part for retaining the pressure release member at a pressure position in the movement directions at which position the biasing member functions. The pressure release member includes a retention element to be held in the first retaining part of the support member. When the retention element is held in the first retaining part of the support member, the pressure release member is configured to apply a biasing force of the biasing member to the support member and thereby to cause the second fixing member to be pressed against the first fixing member. When the retention element is released from the first retaining part of the support member, the pressure release member is configured to stay at a release position in the movement directions at which position the biasing member ceases to apply the biasing force to the support member, and thereby to release the pressure contact state where the second fixing member is pressed against the first fixing member. The present invention also provides an image forming apparatus equipped with the fixing device according to the present invention.

As an exemplary embodiment of the present invention, the pressure release member may include a shaft extending in an orthogonal direction that is orthogonal to the movement directions, and the support member may include a guide unit which supports the shaft of the pressure release member reciprocably in the movement directions.

As another exemplary embodiment of the present invention, the guide unit may have a guide groove which guides the shaft of the pressure release member in a freely movable manner in the movement directions, and the guide groove may have an opening which is open to an outside and through which the shaft of the pressure release member is attachably and detachably inserted.

As yet another exemplary embodiment of the present invention, the biasing member may have one end thereof located on the shaft of the pressure release member, and may have the other end thereof located on a support member for supporting the first fixing member. In this case, the other end of the biasing member is positioned on a first imaginary straight line extending in the movement directions in the pressure contact state where the second fixing member is pressed against the first fixing member, on a second imaginary straight line in a pressure contact release state where the second fixing member is not pressed against the first fixing member, or in an area between the first imaginary straight line in the pressure contact state where the second fixing member is pressed against the first fixing member and the second imaginary straight line in the pressure contact release state where the second fixing member is not pressed against the first fixing member.

As still another exemplary embodiment of the present invention, the retention element of the pressure release member may include a projecting portion which projects in the orthogonal direction that is orthogonal to the movement directions. The support member may be configured to support the shaft of the pressure release member at the guide unit in such a manner that the shaft of the pressure release member can freely turn about a central axis of the shaft. The support member may include a sliding contact portion along which the projecting portion is caused to slide by the biasing force of the biasing member when the pressure release member stays between the pressure position and the release position.

As a further exemplary embodiment of the present invention, the first retaining part of the support member may have a first concave portion formed in the sliding contact portion. The first concave portion may be configured to catch the projecting portion of the retention element when the pressure release member stays at the pressure position.

As an even further example exemplary embodiment of the present invention, the support member may include a second retaining part which holds the retention element of the pressure release member at the release position. The second retaining part may have a second concave portion formed in the sliding contact portion. The second concave portion may be configured to catch the projecting portion of the retention element when the pressure release member stays at the release position.

As a still further exemplary embodiment of the present invention, the support member may be provided with a sloping convex portion in the sliding contact portion between the first concave portion and the second concave portion.

As a different exemplary embodiment of the present invention, the second concave portion may be provided with a first regulating portion which limits movement of the projecting portion of the retention element of the pressure release member in a side opposite to the first concave portion.

As another different exemplary embodiment of the present invention, the guide unit may be provided with a second regulating portion which limits movement of the shaft of the pressure release member in a direction away from the first fixing member.

As a further different exemplary embodiment of the present invention, the biasing member may have a free length when the pressure release member stays at the release position.

As a yet different exemplary embodiment of the present invention, the pressure release member may include a grip which is oriented outwardly in a condition where the fixing device is mounted in the image forming apparatus. In the pressure contact state where the second fixing member is pressed against the first fixing member, downward movement of the grip allows the pressure release member to release the pressure contact state. In the pressure contact released state where the second fixing member is not pressed against the first fixing member, upward movement of the grip allows the pressure release member to press the second fixing member against the first fixing member.

DESCRIPTIONS OF PREFERRED EMBODIMENTS

Hereinafter, embodiments of the present invention are described with reference to the attached drawings.

Figure 1:
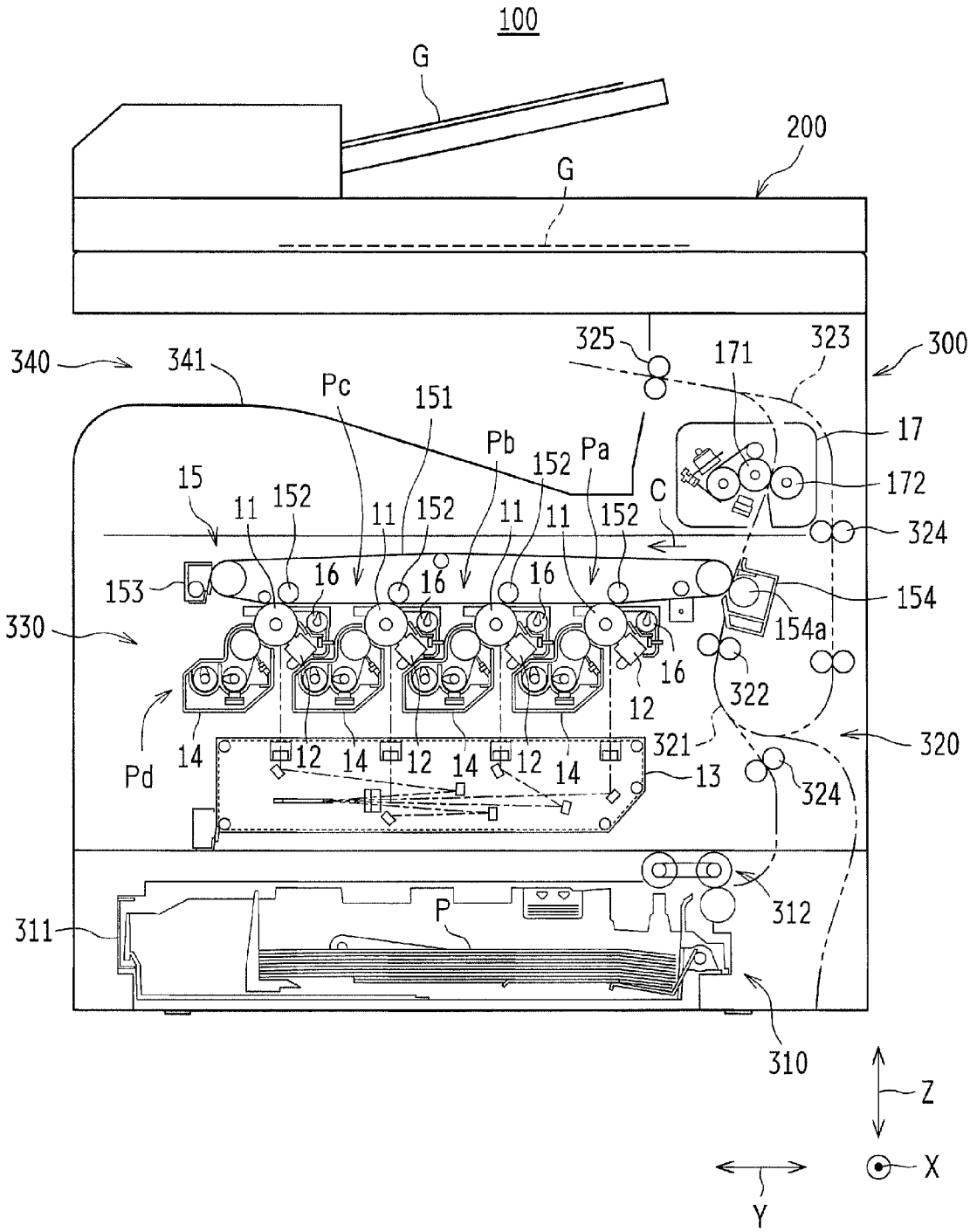
FIG. 1 is a schematic front sectional view of an image forming apparatus equipped with a fixing device according to an embodiment of the present invention.

FIG. 1 is a schematic front sectional view of an image forming apparatus 100 equipped with a fixing device 17 according to an embodiment of the present invention.

<Image Forming Apparatus>

An image forming apparatus 100 has a copying function of reading an image in an original copy G and forming an image on a recording sheet P such as a sheet of recording paper. The image forming apparatus 100 is equipped with an image scanner 200 for reading an image in an original copy G, and a main body 300 for forming an image on a recording sheet P.

The main body 300 of the image forming apparatus 100 includes a sheet feeding unit 310, a sheet conveying unit 320, an image forming unit 330, and a sheet discharge unit 340. The main body 300 is installed horizontally.

Image data processed in the image forming unit 330 include color image data in black (K), cyan (C), magenta (M), and yellow (Y), and monochrome image data in a single color (e.g. black). In order to form four color images, the image forming unit 330 is provided with four photosensitive drums 11, four chargers 12, four developing units 14, four intermediate transfer rollers 152 in a transfer unit 15, and four drum cleaners 16. These components constitute four imaging stations Pa, Pb, Pc, Pd which are associated with black, cyan, magenta, and yellow, respectively. In the imaging stations Pa, Pb, Pc, Pd, practically same elements are identified with same reference numerals.

Image formation in the main body 300 of the image forming apparatus 100 involves following processes. First, the intermediate transfer belt 151 in the transfer unit 15 revolves in the direction of Arrow C and causes rotation of the photosensitive drums 11. Then, surfaces of the photosensitive drums 11 are uniformly charged by the chargers 12 at a given potential and exposed by an optical scanner 13 so as to form electrostatic latent images on the surfaces. The electrostatic latent images on the surfaces of the photosensitive drums 11 are developed by the developing units 14, thereby forming toner images (unfixed images) on the surfaces of the photosensitive drums 11. In this manner, toner images in four colors are formed on the surfaces of the photosensitive drums 11. Later, residual toner on the surfaces of the photosensitive drums 11 is removed and collected by the drum cleaners 16.

Next, while the intermediate transfer belt 151 revolves in the direction of Arrow C, the toner images in four colors formed on the surfaces of the photosensitive drums 11 are successively transferred and overlapped on the intermediate transfer belt 151 by the intermediate transfer rollers 152 to which a transfer bias is applied, thereby forming a color toner image on the intermediate transfer belt 151. In this manner, a color toner image is formed on the surface of the intermediate transfer belt 151. Later, residual toner on the surface of the intermediate transfer belt 151 is removed and collected by a belt cleaner 153.

In the sheet feeding unit 310, a recording sheet P loaded in a feeding cassette 311 is pulled out of a feeding cassette 311 by a sheet feeding roller unit 312, and is conveyed to the image forming unit 330 via a sheet conveying path 321 in the sheet conveying unit 320. The sheet conveying path 321 is provided with registration rollers 322, conveying rollers 324, and discharge rollers 325. The registration rollers 322 temporality stop (suspend) the recording sheet P so as to align a leading end of the recording sheet P. Thereafter, the registration rollers 322 resume conveying the recording sheet P, in time with the transfer operation of the color toner image at a transfer nip region between the intermediate transfer belt 151 and a transfer roller 154*a* of a secondary transfer unit 154.

While the recording sheet P, conveyed from the sheet feeding unit 310 via the sheet conveying path 321 in the sheet conveying unit 320 to the image forming unit 330, is nipped in and conveyed through the transfer nip region between the intermediate transfer belt 151 and the transfer roller 154*a*, the color toner image on the surface of the intermediate transfer belt 151 is transferred on the recording sheet P by the transfer roller 154*a* to which a transfer bias is applied. The recording sheet P is then held in between a fixing roller 171 and a pressure roller 172 of the fixing device 17, and is heated and pressed therebetween, thereby fixing the color toner image formed on the recording sheet P. The recording sheet P is further conveyed toward the sheet discharge unit 340, and is discharged in a discharge tray 341 of the sheet discharge unit 340 through the discharge rollers 325.

After an image is formed on the front surface of the recording sheet P, if another image is to be formed on a back surface thereof, the recording sheet P on which a toner image is fixed on the front surface by the fixing device 17 is conveyed in a reverse direction by the discharge rollers 325 toward a reverse path 323. The recording sheet P is reversed in the reverse path 323 and guided again to the registration rollers 322. Then, in the same manner as for the front surface of the recording sheet P, a toner image is formed and fixed on the back surface of the recording sheet P, and the recording sheet P is discharged in the discharge tray 341 of the sheet discharge unit 340. In FIG. 1 and in FIGS. 2-15 to be described later, X represents a depth direction on the horizontal plane, Y represents a width direction on the horizontal plane orthogonal to the depth direction X, and Z represents a top-bottom (vertical) direction orthogonal to the horizontal plane.

<Fixing Device>

The fixing device 17 according to the embodiment illustrated in FIG. 1 is hereinafter described in detail.

Figure 2:
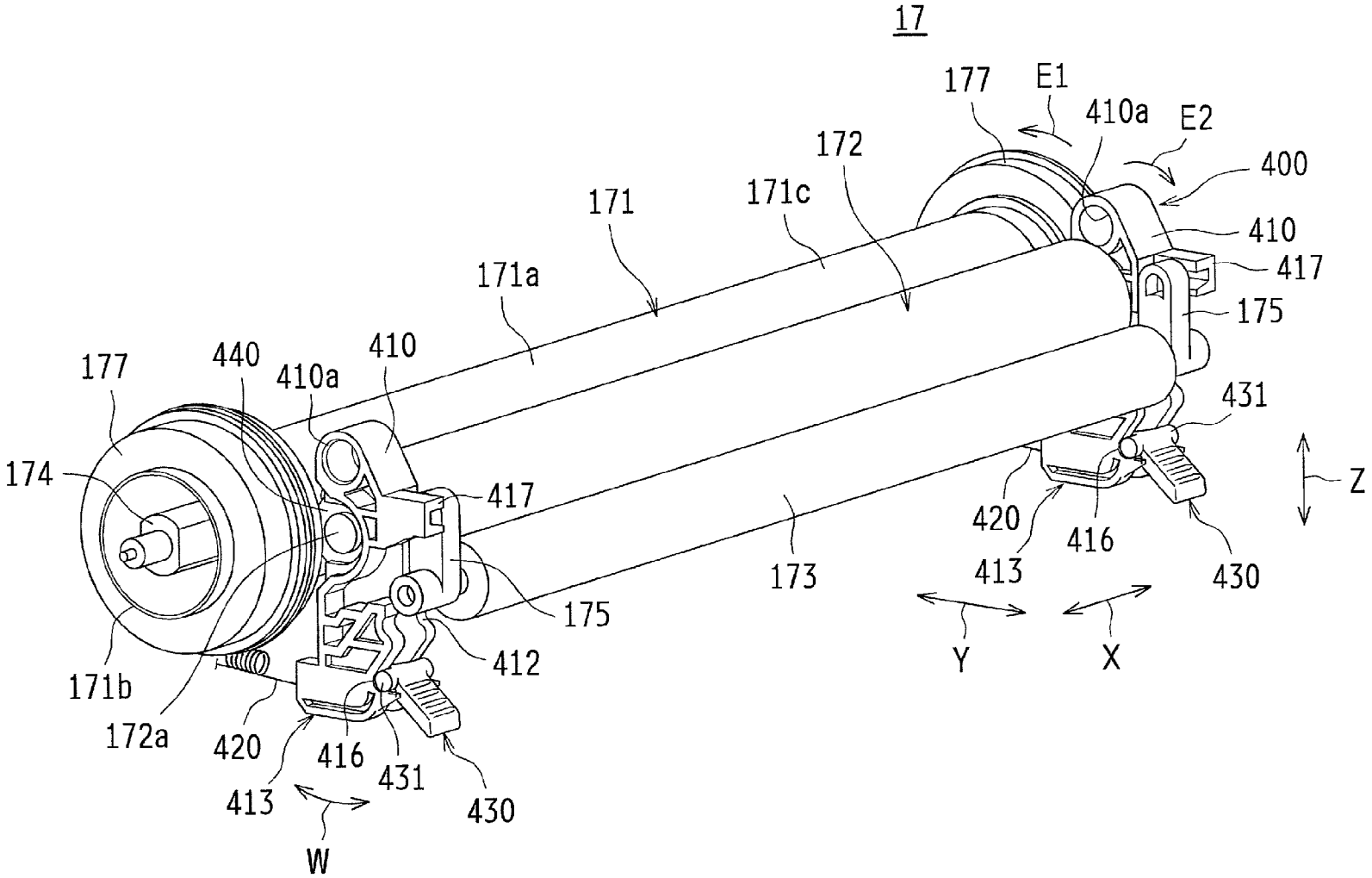
FIG. 2 is a schematic perspective view of a main part of a fixing device according to this embodiment, showing a pressure contact release state where a pressure roller is not pressed against a fixing roller.
Figure 3:
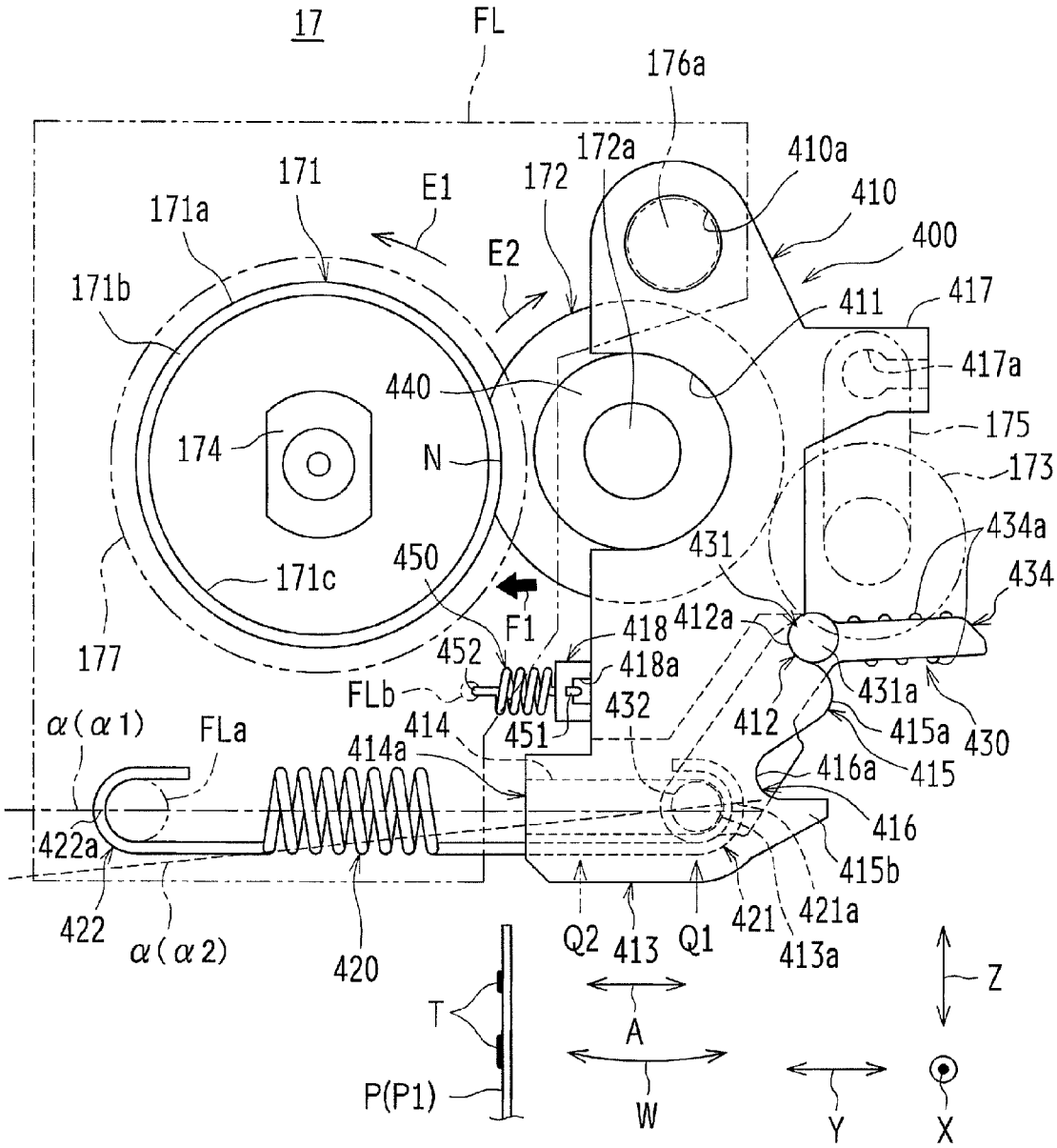
FIG. 3 is a schematic front view of the fixing device shown in FIG. 2, showing a pressure contact state where the pressure roller is pressed against the fixing roller.
Figure 4:
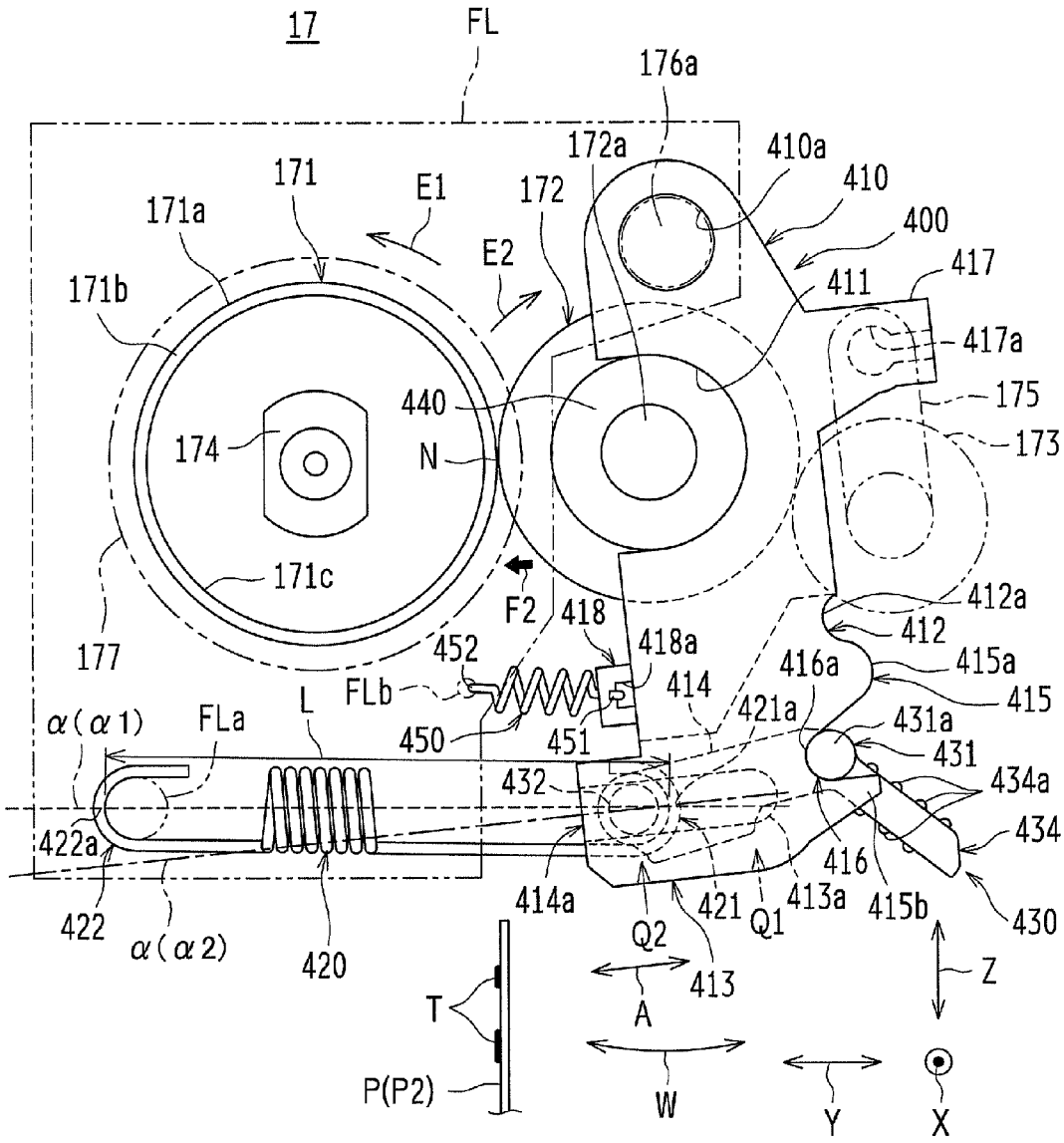
FIG. 4 is a schematic front view of the fixing device shown in FIG. 2, showing a pressure contact release state where the pressure roller is not pressed against the fixing roller.

FIG. 2 is a schematic perspective view of a main part of the fixing device 17 according to this embodiment, showing a pressure contact release state where the pressure roller 172 is not pressed against the fixing roller 171. FIGS. 3 and 4 are schematic front views of the fixing device 17 shown in FIG. 2. FIG. 3 shows a pressure contact state where the pressure roller 172 is pressed against the fixing roller 171. FIG. 4 shows a pressure contact release state where the pressure roller 172 is not pressed against the fixing roller 171.

In the fixing device 17, one end and the other end in the depth direction X look almost identical except that the other end is a mirror image of the one end. Hence, FIGS. 2-4 and FIGS. 5A-10 to be described later illustrate only the one end in the depth direction X and omit the other end in the depth direction X. In addition, FIG. 2 further omits a main body frame FL.

The fixing device 17 is equipped with a fixing roller 171 (an example of the first fixing member) for fixing a toner image (an unfixed image composed of toner T) on the recording sheet P (see FIGS. 3 and 4), a pressure roller 172 (an example of the second fixing member) opposed to the fixing roller 171, and a pressure contact unit 400 for pressing the pressure roller 172 against the fixing roller 171 and releasing the pressure contact state where the pressure roller 172 is pressed against the fixing roller 171. With the fixing roller 171 and the pressure roller 172 being pressed against each other by the pressure contact unit 400, the fixing device 17 forms a fixing nip region (a fixing nip part) N (see FIGS. 3 and 4) between the fixing roller 171 and the pressure roller 172. Detailed description of the pressure contact unit 400 will be given later.

In this embodiment, the fixing roller 171 is provided with a heat source 174, such as a halogen heater lamp, which heats a roller surface 171*a*.

To be specific, the fixing roller 171 has its rotation shaft 171*b* rotatably held on a main body (specifically, a main body frame FL, see FIGS. 3 and 4) of the fixing device 17 by means of bearings 177. The fixing roller 171 has a tubular cored bar 171*c*, and is arranged to face a toner T side of the conveyed recording sheet P. The heat source 174 is provided inside the cored bar 171*c* of the fixing roller 171. Owing to this arrangement, the roller surface 171*a* of the fixing roller 171 is heated by the heat source 174, and the heat on the roller surface 171*a* is conducted to the toner T on the recording sheet P. Then, in a state where the pressure roller 172 is pressed against the fixing roller 171 with the interposition of the recording sheet P and the recording sheet P is held in the fixing nip region N between the fixing roller 171 and the pressure roller 172, the fixing roller 171 thermally fixes the toner T on the recording sheet P in cooperation with the pressure roller 172. Although the pressure roller 172 is not provided with a heat source in this embodiment, the pressure roller 172 may be provided with a heat source.

In a state where the fixing device 17 in this configuration is mounted in the main body 300 of the image forming apparatus 100 (see FIG. 1), a drive mechanism (such as a gear, not shown) in the main body 300 meshes with a gear (not shown) provided on the rotation shaft 171*b* of the fixing roller 171. A rotational driving force from the drive mechanism in the main body 300 is transmitted via the gear to the rotation shaft 171*b* of the fixing roller 171, thereby driving the fixing roller 171 to rotate in a predetermined rotation direction E1. Along with the rotation of the fixing roller 171, the pressure roller 172 is driven to rotate in a rotation direction E2 that is reverse to the rotation direction E1 of the fixing roller 171. The recording sheet P is conveyed between the fixing roller 171 and the pressure roller 172 in a sandwiched manner, and is heated and pressed at the fixing nip region N. Eventually, unfixed toner T on the recording sheet P is fused, mixed, pressed, and thermally fixed.

(Pressure Contact Unit)

The next description is directed to the pressure contact unit 400 provided in the fixing device 17 according to this embodiment.

The pressure contact unit 400 is equipped with pressure levers 410 (an example of the support member) which support the pressure roller 172 such that the pressure roller 172 can approach and separate from the fixing roller 171, first pressure springs 420 (an example of the biasing member), such as coil springs, for biasing the pressure levers 410 such that the pressure roller 172 is pressed against the fixing roller 171, and pressure release levers 430 (an example of the pressure release member) for releasing the pressure contact state where the pressure roller 172 is pressed against the fixing roller 171. In this context, the term "approach and separate from" means that the pressure roller 172 is allowed to move in a direction toward the fixing roller 171 and in a direction away from the fixing roller 171.

In this embodiment, the pressure levers 410 are configured to hold the pressure roller 172 in such a manner that the pressure roller 172 can rotationally move in approaching/separating directions W relative to the fixing roller 171, around a rotational axis extending along a rotation shaft 172*a* of the pressure roller 172 (specifically, rotational supporting points 176*a*, see FIGS. 3 and 4). In this context, the approaching/separating directions W indicate a direction for pressing the pressure roller 172 against the fixing roller 171 and a direction for releasing the pressure contact state where the pressure roller 172 is pressed against the fixing roller 171.

In detail, the pressure levers 410 rotatably hold the rotation shaft 172*a* of the pressure roller 172, and the pressure levers 410 themselves are rotatable around the rotational supporting points 176*a*. In this embodiment, the rotational supporting points 176*a* are support pins which constitute rotation shafts extending along the rotation shaft 172*a* of the pressure roller 172 and secured on the main body (specifically, the main body frame FL, see FIGS. 3 and 4) of the fixing device 17.

To be specific, the pressure levers 410 are composed of a pair of pressure levers 410, 410 provided at each end of the rotation shaft 172*a* of the pressure roller 172.

The pair of pressure levers 410, 410 has receiver portions 411, 411 for receiving each end of the rotation shaft 172*a* of the pressure roller 172. In the pair of pressure levers 410, 410, the rotation shaft 172*a*, 172*a* at each end of the pressure roller 172 is rotatably held in the receiver portions 411, 411 by way of bearings 440, 440.

The pair of pressure levers 410, 410 is also provided with, at one end portion thereof in a predetermined direction (above the pressure roller 172 in the example shown in FIGS. 3 and 4), latching parts 410*a* for rotatably latching the rotational supporting points 176*a*. In this embodiment, the latching parts 410*a* are through holes, through which the rotational supporting points 176*a* are rotatably inserted.

The pressure release levers 430 are composed of a pair of pressure release levers 430, 430 which are attached one by one to the pair of pressure levers 410, 410. The first pressure springs 420 are composed of a pair of first pressure springs 420, 420 which are associated one by one with the pair of pressure release levers 430, 430.

In the fixing device 17 shown in FIGS. 2-4, the reference signs not yet mentioned will be described later.

Figure 5A:
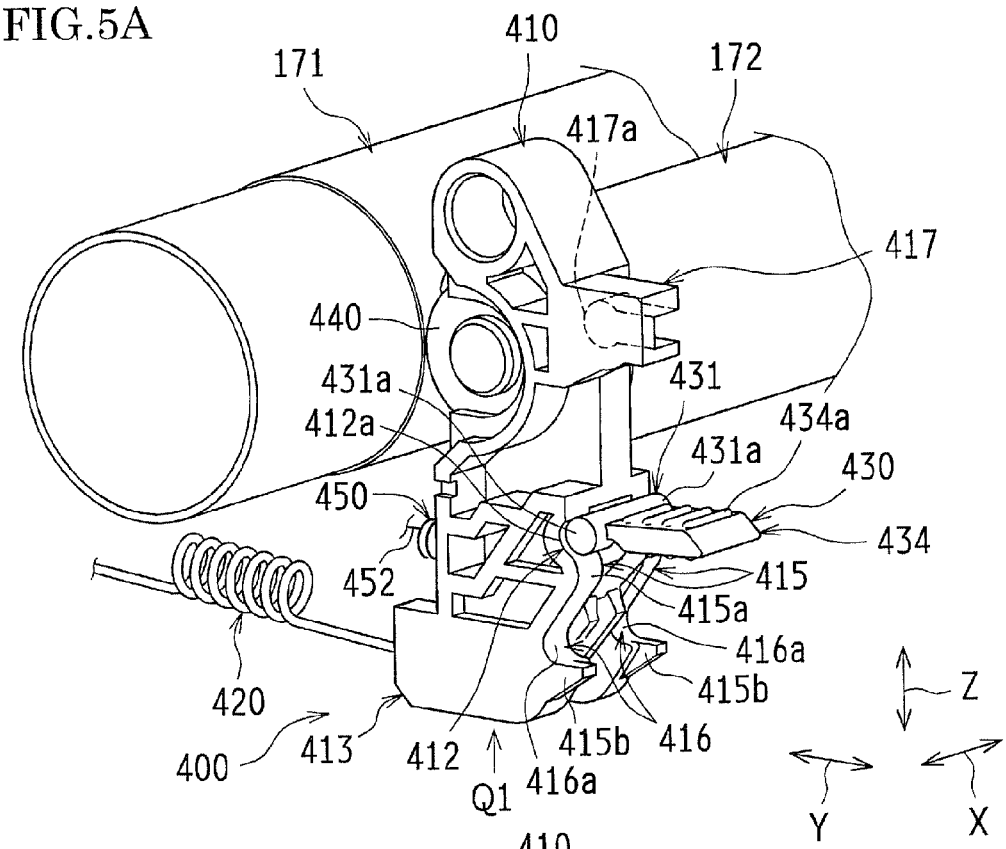
FIG. 5A is a top perspective view of a portion around one of pressure levers and one of pressure release levers in a pressure contact unit, with the pressure release lever being at a pressure position.
Figure 5B:
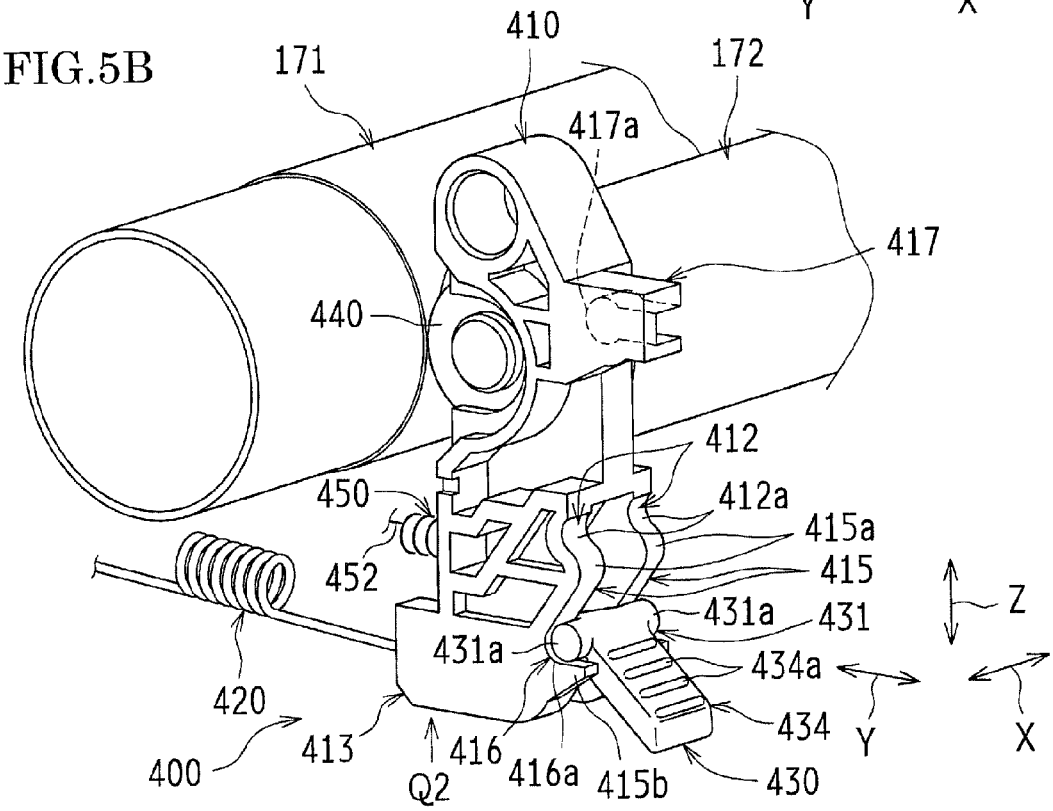
FIG. 5B is a top perspective view of a portion around one of pressure levers and one of pressure release levers in the pressure contact unit, with the pressure release lever being at a release position.
Figure 6A:
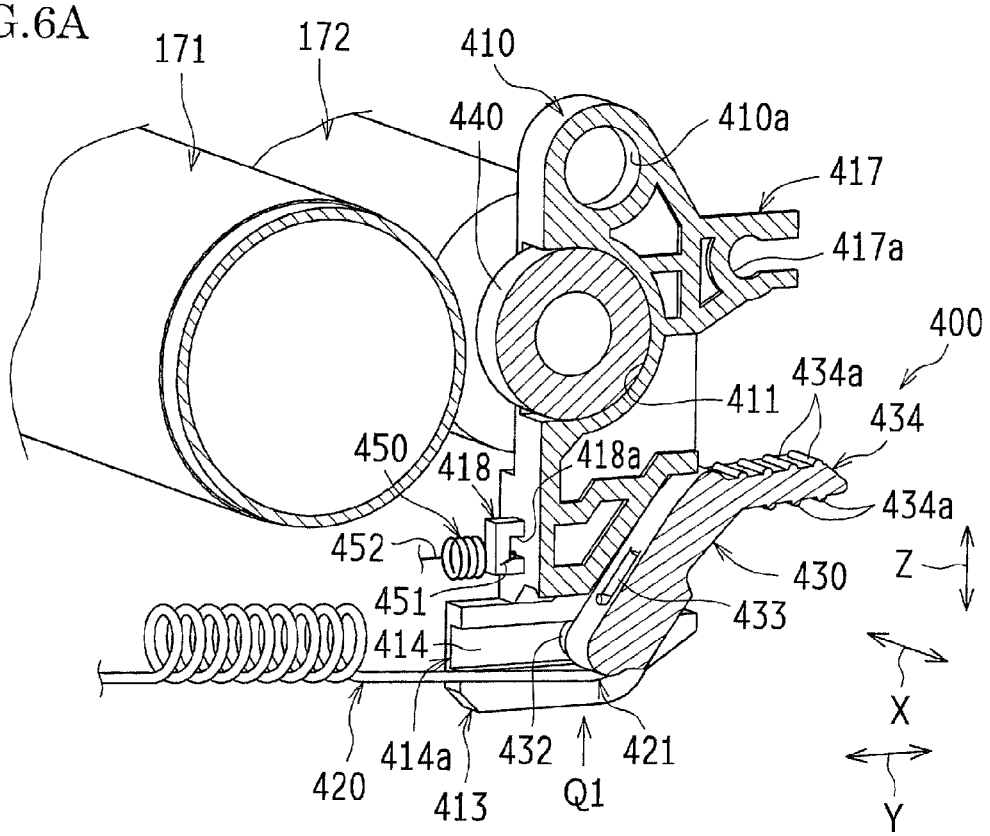
FIG. 6A is a top front perspective view of a portion around the pressure lever and the pressure release lever in the pressure contact unit, shown in section taken in the middle in the depth direction, with the pressure release lever being at the pressure position.
Figure 6B:
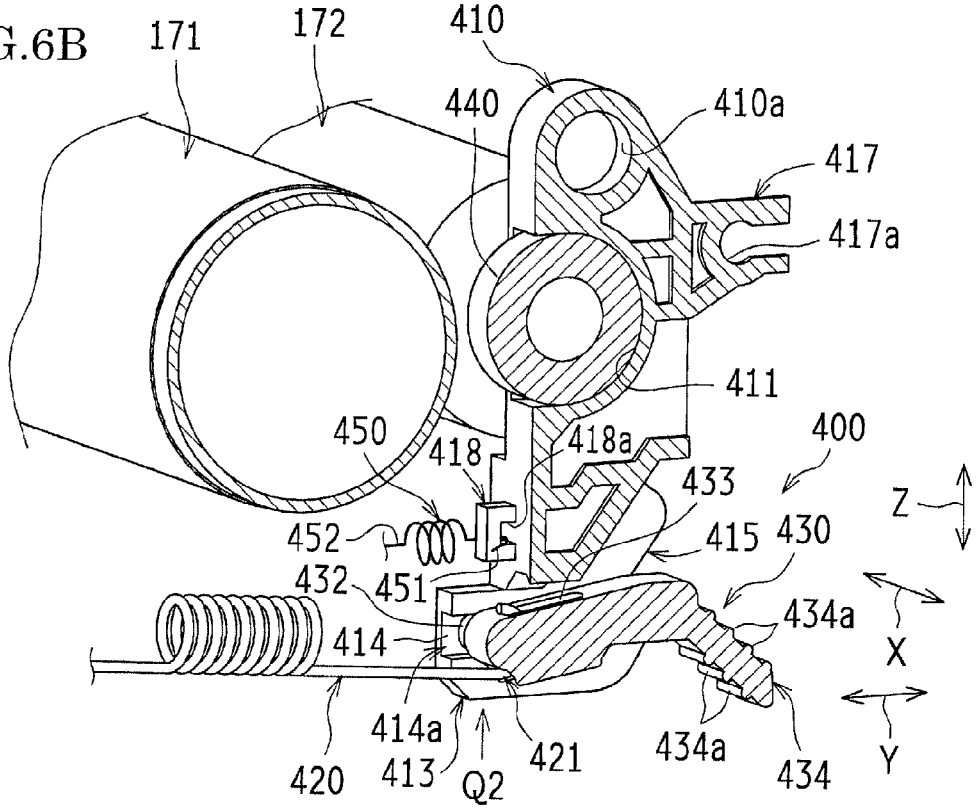
FIG. 6B is a top front perspective view of a portion around the pressure lever and the pressure release lever in the pressure contact unit, shown in section taken in the middle in the depth direction, with the pressure release lever being at the release position.
Figure 7A:
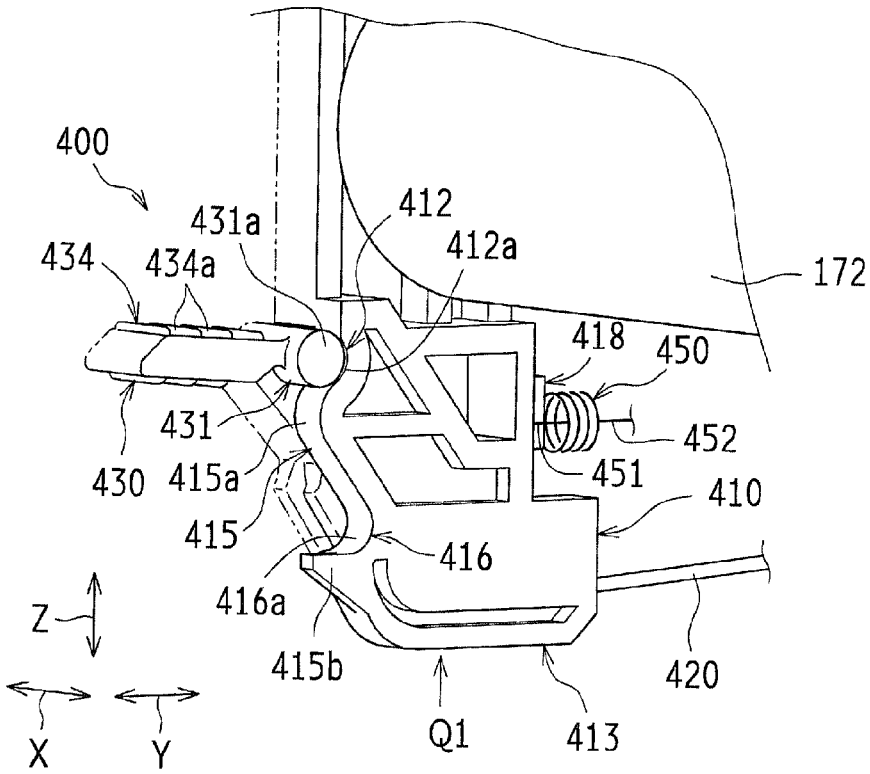
FIG. 7A is a top rear perspective view of the sections shown in FIG. 6A, with the pressure release lever being at the pressure position.
Figure 7B:
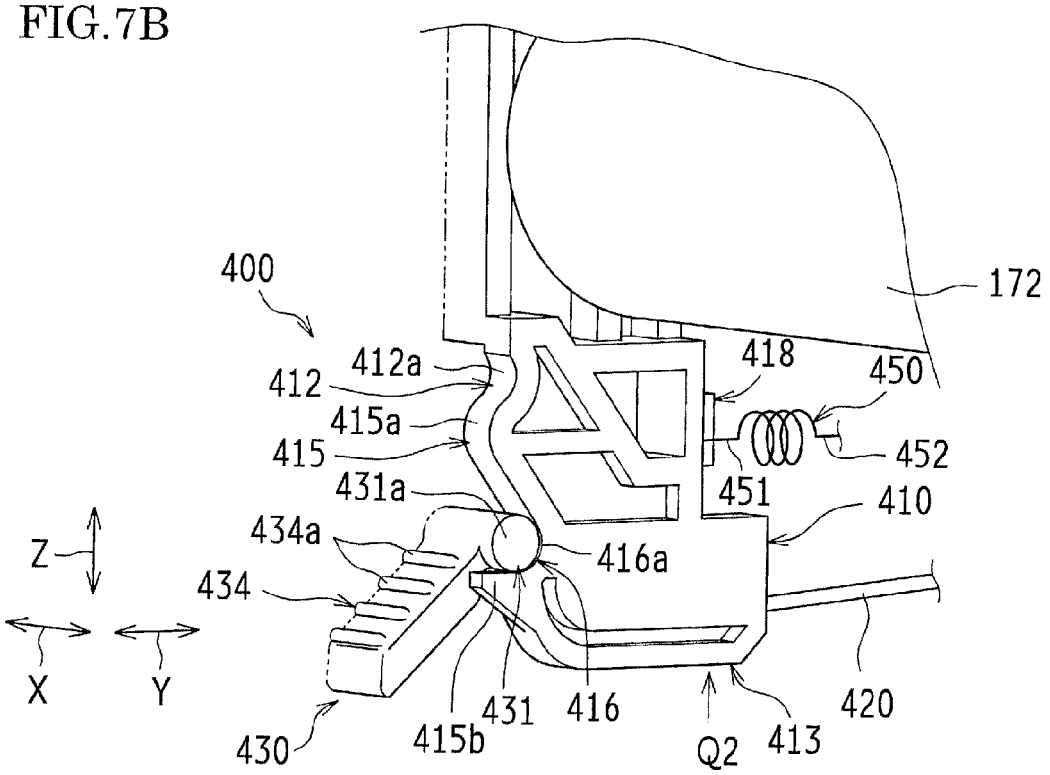
FIG. 7B is a top rear perspective view of the sections shown in FIG. 6B, with the pressure release lever being at the release position.

FIGS. 5A and 5B are top perspective views of a portion around one of the pressure levers 410 and one of the pressure release levers 430 in the pressure contact unit 400. FIG. 5A shows the state where the pressure release lever 430 is at a pressure position Q1, and FIG. 5B shows the state where the pressure release lever 430 is at a release position Q2. FIGS. 6A and 6B are top front perspective views of a portion around the pressure lever 410 and the pressure release lever 430 in the pressure contact unit 400, shown in section taken in the middle in the depth direction X. FIGS. 7A and 7B are top rear perspective views of the sections shown in FIGS. 6A and 6B. FIGS. 6A and 7A show the state where the pressure release lever 430 is at the pressure position Q1, and FIGS. 6B and 7B show the state where the pressure release lever 430 is at the release position Q2. Note that FIGS. 5A-7B omit the main body frame FL, the cleaning roller 173, the intermediate supports 175, etc.

Figure 8:
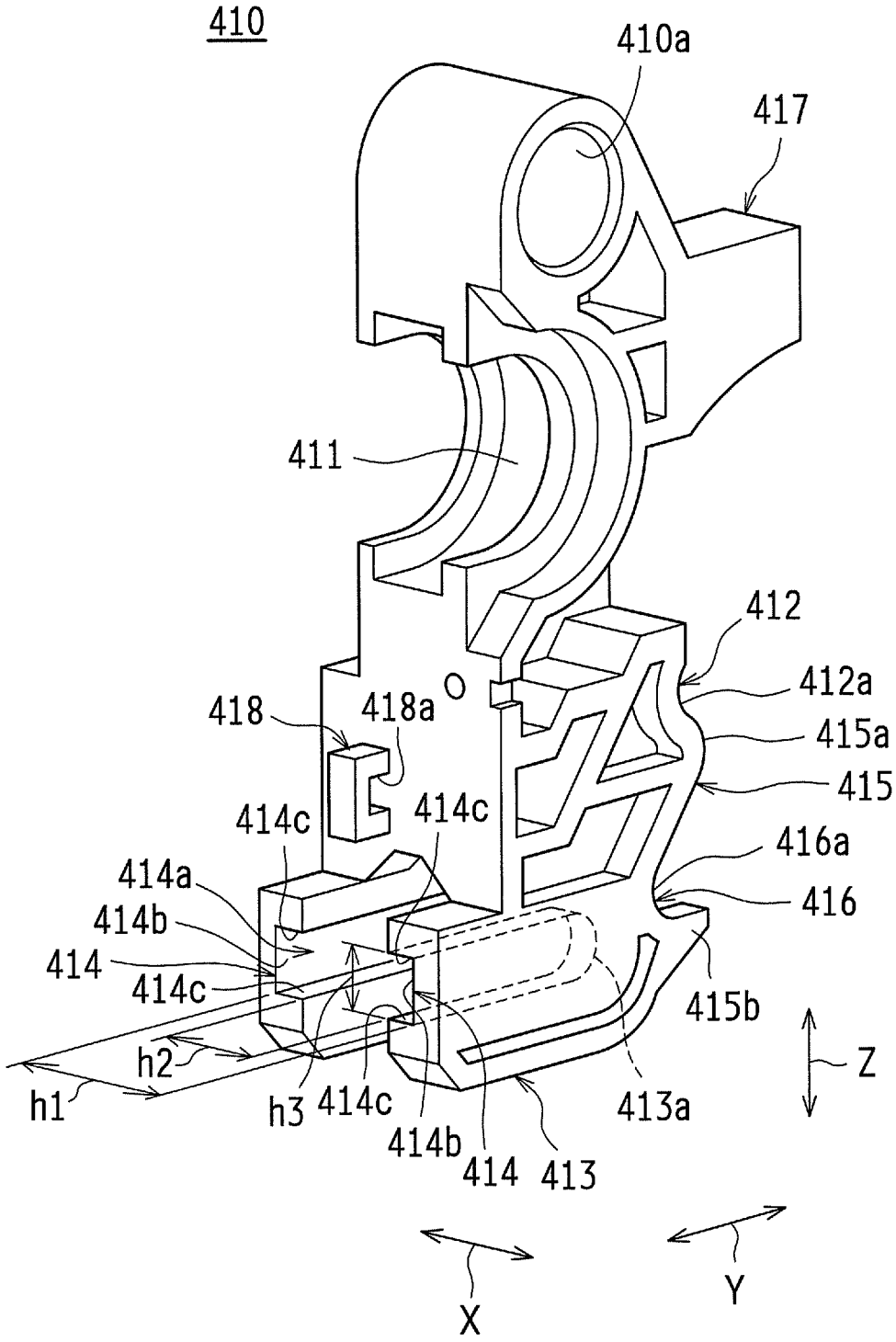
FIG. 8 is a front top perspective view of one of the pressure levers in the pressure contact unit.
Figure 9:
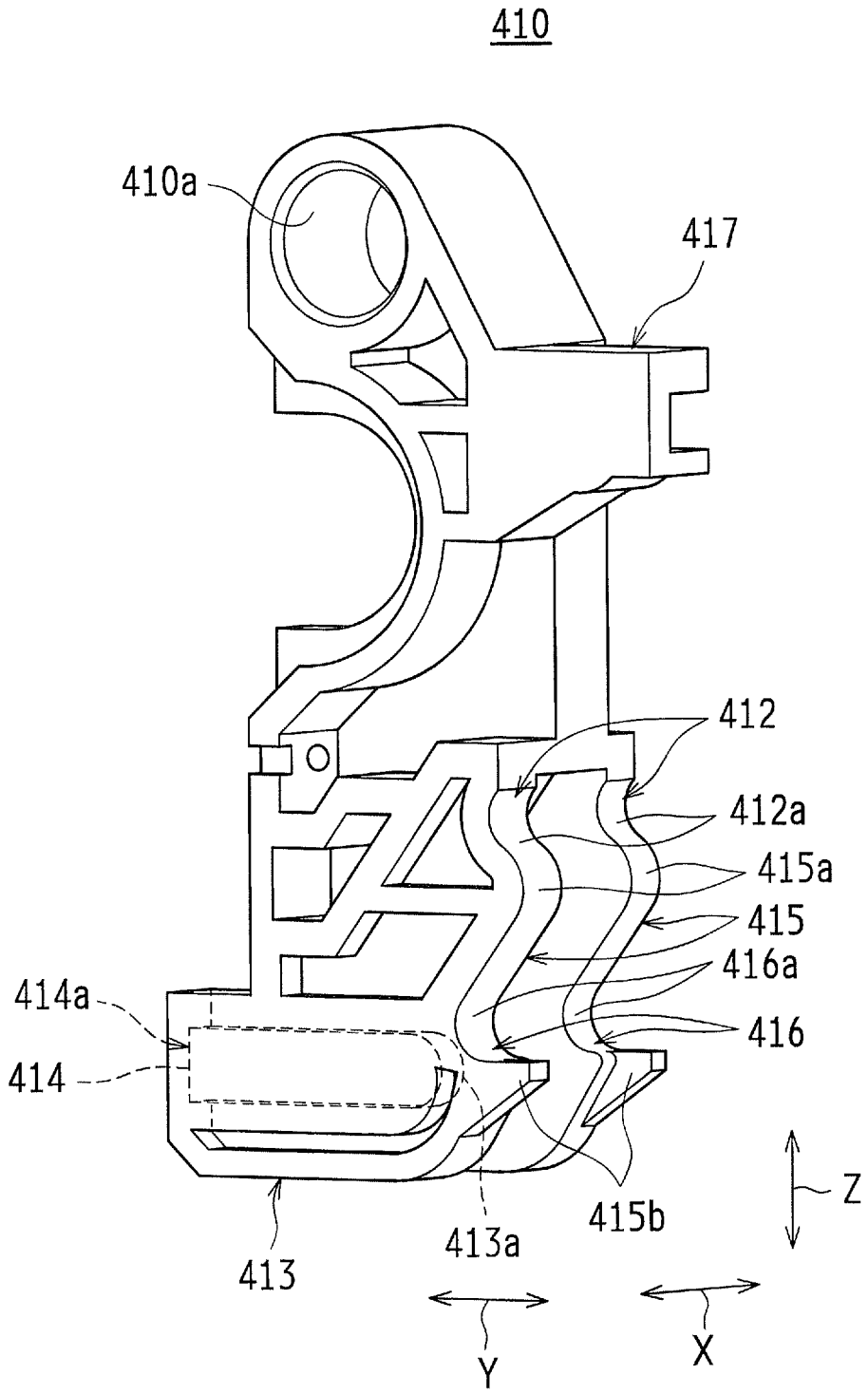
FIG. 9 is a rear bottom perspective view of one of the pressure levers in the pressure contact unit.
Figure 10:
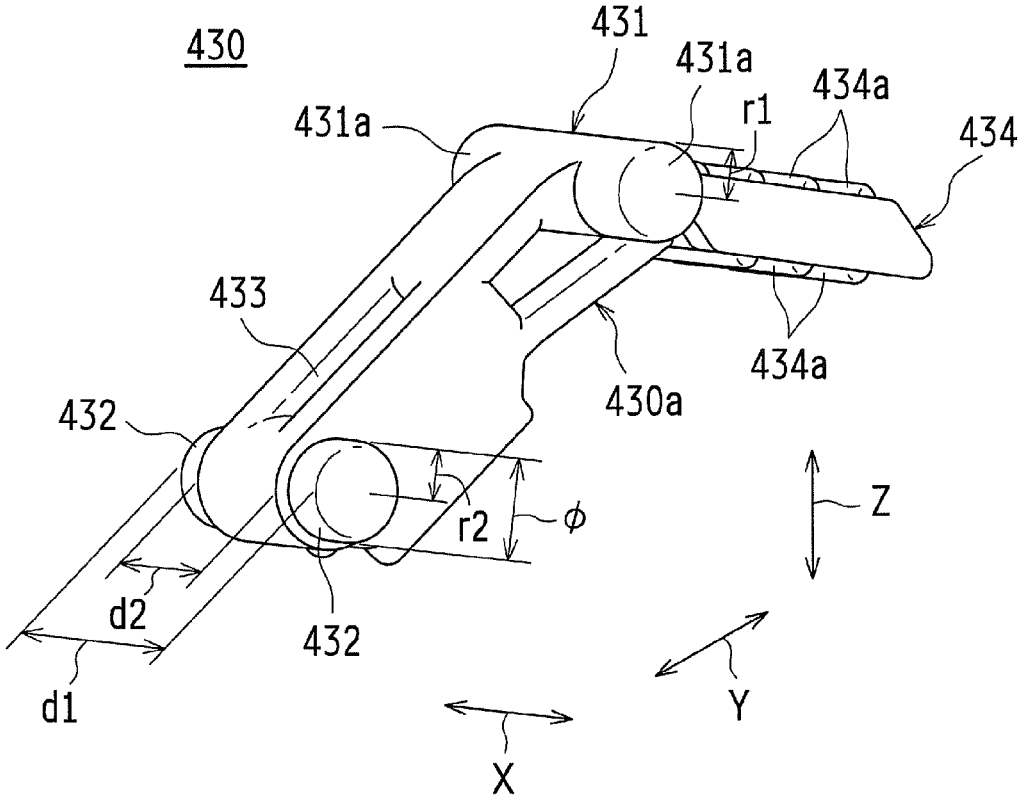
FIG. 10 is a top perspective view of one of the pressure release levers in the pressure contact unit.

FIGS. 8 and 9 are a front top perspective view and a rear bottom perspective view, respectively, of one of the pressure levers 410 in the pressure contact unit 400. FIG. 10 is a top perspective view of one of the pressure release levers 430 in the pressure contact unit 400.

In the fixing device 17 according to this embodiment, the pressure contact unit 400 is configured to move the pair of pressure release levers 430, 430 relative to the pair of pressure levers 410, 410 in predetermined movement directions A (see FIGS. 3 and 4) that are set in advance so as to cause the pair of first pressure springs 420, 420 to function (or so as to generate a biasing force by the pair of first pressure springs 420, 420).

To be more specific, the pressure contact unit 400 is configured to move the pair of pressure release levers 430, 430 relative to the pair of pressure levers 410, 410 along an imaginary line in the movement directions A (in this context, an imaginary straight line $\alpha$ in a straight direction, namely, the dot-dashed line $\alpha 1$ in FIG. 3, or the dot-dashed line $\alpha 2$ in FIG. 4). The movement directions A conceptionally include not only straight directions but also circular directions and wavy directions, and examples of the imaginary line in the movement directions A include not only an imaginary straight line but also an imaginary arc extending in circular directions, or an imaginary wavy line extending in wavy directions.

Each of the pressure levers 410, 410 is equipped with a pair of first retaining parts 412 (see FIGS. 2-5B and 7A-9) for holding the corresponding one of pressure release levers 430, 430 (a predetermined part in the corresponding pressure release lever 430, specifically, a retention element (an element to be retained) 431 to be described later, see FIGS. 2-5B 7A, 7B, and 10) at the pressure position Q1 (see FIGS. 3, 5A, 6A, and 7A), where the pair of first pressure springs 420, 420 functions in the movement directions A (in this situation, on the imaginary straight line α) (i.e. where the pair of first pressure springs 420, 420 generates a biasing force). To be specific, the pair of first retaining parts 412 is composed of a pair of retaining surfaces formed on a side surface of each pressure lever 410, opposite to the other side surface facing the fixing roller 171.

The pair of pressure release levers 430, 430 is provided with retention elements 431 which are held in the first retaining parts 412 in the pair of pressure levers 410, 410 (see FIGS. 2-5B, 7A, 7B, and 10).

When the retention elements 431 are held in the first retaining parts 412 of the pair of pressure levers 410, 410 (see FIGS. 3, 5A, 6A, and 7A), the pair of pressure release levers 430, 430 is configured to apply a biasing force by the pair of first pressure springs 420, 420 to the pair of pressure levers 410, 410, and thereby to press the pressure roller 172 against the fixing roller 171. On the other hand, when the retention elements 431 are not held in the first retaining parts 412 of the pair of pressure levers 410, 410 (see FIGS. 4, 5B, 6B, and 7B), the pair of pressure release levers 430, 430 is configured to stay at the release position Q2 (specifically, in the state where the shafts 432 stay at the release position Q2) in the movement directions A (on the imaginary straight line α (α2) in this embodiment, see the dot-dashed line in FIG. 4) at which position the pair of first pressure springs 420 ceases to apply the biasing force to the pair of pressure levers 410, 410, and thereby to release the pressure contact state where the pressure roller 172 is pressed against the fixing roller 171.

In this embodiment, when the pressure roller 172 is pressed against the fixing roller 171, the pair of pressure release levers 430, 430 (specifically, the shafts 432) is located at the pressure position Q1 on the imaginary straight line α (α1) (see the dot-dashed line in FIG. 3), so that the retention elements 431 are held in the first retaining parts 412 of the pair of pressure levers 410, 410. In this state, a biasing force of the pair of first pressure springs 420, 420 can be transmitted to the pair of pressure levers 410, 410 via the pair of pressure release levers 430, 430. Through this process, the pressure roller 172 held by the pair of pressure levers 410, 410 can be pressed against the fixing roller 171. On the other hand, in order to release the pressure roller 172 from the pressure contact with the fixing roller 171 while the pair of pressure levers 410, 410 stays at the pressure position Q1, the retention elements 431 of the pair of pressure release levers 430, 430 are released from the first retaining parts 412 of the pair of pressure levers 410, 410, so that the pair of pressure release levers 430, 430 (specifically, the shafts 432) is allowed to move to the release position Q2 on the imaginary straight line α (α2). In this state, a biasing force of the pair of first pressure springs 420, 420 is no longer transmitted to the pair of pressure levers 410, 410 via the pair of pressure release levers 430, 430. Through this process, the pressure roller 172 held by the pair of pressure levers 410, 410 can be released from the pressure contact with the fixing roller 171.

In this regard, the pressure contact unit 400 is configured to press the pressure roller 172 against the fixing roller 171 via the pair of pressure levers 410, 410 with a predetermined pressure contact force F (in this embodiment, the pressing force is 254.9729 N or 26 kgf) generated by the pair of first pressure springs 420, 420. The pressure contact unit 400 is also configured to release the pressure contact state where the pressure roller 172 is pressed against the fixing roller 171 via the pressure levers 410 with a pressure contact force F (in this embodiment, the biasing force of the pair of first pressure springs 420, 420 is reduced to zero).

Unlike the conventional manner of employing a cam to release the pressure contact state where the pressure roller (the second fixing member) is pressed against the fixing roller (the first fixing member), the fixing device according to this embodiment is configured to move the pair of pressure release levers 430, 430 relative to the pair of pressure levers 410, 410 in the movement directions A (on the imaginary straight line α in this embodiment). The pair of pressure levers 410, 410 is provided with the first retaining parts 412 for holding the pair of pressure release levers 430, 430 at the pressure position Q1 where the pair of first pressure springs 420, 420 functions in the movement directions A (on the imaginary straight line α in this embodiment). The pair of pressure release levers 430, 430 is provided with the retention elements 431 to be held in the first retaining parts 412 of the pair of pressure levers 410, 410. Eventually, the structure for activating the pair of pressure release levers 430, 430 can be made of fewer components, and thereby an installation space and costs for the device can be reduced.

In this embodiment, the pair of pressure release levers 430, 430 is provided with the shafts 432 which extend in a direction (the depth direction X in this embodiment) orthogonal to the movement directions A (along the imaginary straight line α in this embodiment). The pair of pressure levers 410, 410 is provided with guide units 413 for supporting the shafts 432 of the pair of pressure release levers 430, 430 reciprocably in the movement directions A (on the imaginary straight line α in this embodiment).

Owing to this configuration, the guide units 413 of the pair of pressure levers 410, 410 can reliably reciprocate the shafts 432 of the pair of pressure release levers 430, 430 in the movement directions A (on the imaginary straight line α in this embodiment).

To be specific, each shaft 432 is provided at an end of each pressure release lever 430. Each guide unit 413 is provided in each pressure lever 410, at an opposite end to the rotational supporting point 176*a* over the pressure roller 172.

In this embodiment, each guide unit 413 has a pair of guide grooves 414 (see FIGS. 3, 4, 6A, 6B, 8, and 9) for guiding the shafts 432 of the pair of pressure release levers 430, 430 in a freely movable manner in the movement directions A (along the imaginary straight line α in this embodiment). Each pair of guide grooves 414 has a pair of openings 414*a* which is open to the outside and through which the shaft 432 of the corresponding one of pressure release levers 430, 430 is attachably and detachably inserted.

Since each pair of openings 414*a* is open to the outside and the shaft 432 of each pressure release lever 430 is attachably and detachably inserted through the openings 414*a*, the shaft 432 of each pressure release lever 430 can be easily attached to or detached from the pair of guide grooves 414 in each guide unit 413. As a result, the shafts 432 of the pair of pressure release levers 430, 430 can be assembled into the guide units 413 more efficiently.

To be specific, the shaft 432 in each pressure release lever 430 (see FIG. 10) is a columnar shaft locating at an end of a main body 430*a* of the pressure release lever 430 and projecting from both side faces in the depth direction X. The pair of guide grooves 414 in each guide unit 413 (see FIG. 8) has a pair of first guide surfaces (guide walls) 414*b*, 414*b* and second guide surfaces (guide walls) 414*c*, 414*c*. The first guide surfaces 414*b*, 414*b* are formed on both end faces in the depth direction X, and extend in the width direction Y and the vertical direction Z, spaced from each other by a predetermined first gap h1 (see FIG. 8). The first guide surfaces 414*b*, 414*b* limit depthwise X-direction movements of the shaft 432 of each pressure release lever 430. The second guide surfaces 414*c*, 414*c* originate from the first guide surfaces 414*b*, 414*b* at both vertical Z-direction ends thereof, and extend inwardly of the pair of guide groove 414 in the depth direction X, spaced from each other by a predetermined second gap h2 (see FIG. 8). The second guide surfaces 414*c*, 414*c* limit vertical Z-direction movements of the shaft 432 of each pressure release lever 430. The first gap h1 is slightly greater than a depthwise X-direction length d1 (see FIG. 10) of the shaft 432 of each pressure release lever 430, by such a degree that the shaft 432 can smoothly move in the width directions Y, through a space created in the depth direction X between the pair of first guide surfaces 414*b*, 414*b*. The second gap h2 is slightly greater than a depthwise X-direction length d2 (see FIG. 10) of the main body 430*a* of each pressure release lever 430, by such a degree that the main body 430*a* of each pressure release lever 430 can smoothly move in the width directions Y, through a space created in the depth direction X between the second guide surfaces 414*c*, 414*c*. A third gap h3 (see FIG. 8) created in the vertical direction Z between the second guide surfaces 414*c*, 414*c* is slightly greater than a diameter ϕ (see FIG. 10) of the shaft 432 of each pressure release lever 430, by such a degree that the shaft 432 can smoothly move in the width directions Y, through a space created in the vertical direction Z between the second guide surfaces 414*c*.

Incidentally, if the pair of first pressure springs 420, 420 receives a force in an unwanted direction, smooth movement of the shafts 432 in the guide units 413 is hampered.

Therefore, in this embodiment, one ends 421*a* of the pair of first pressure springs 420, 420 (see FIGS. 3 and 4) are hooked on the shafts 432 of the pressure release levers 430. Second ends 422*a* of the pair of first pressure springs 420, 420 are hooked on a member of the main body of the fixing device 17 (on the main body frame FL of the fixing device 17 in this embodiment) which serve as a support member for supporting the fixing roller 171, such that the other ends 422*a* are positioned on the imaginary straight line α (α1) (see the dot-dashed line in FIG. 3) in the pressure contact state where the pressure roller 172 is pressed against the fixing roller 171. In this context, the one end 421*a* and the other end 422*a* of each first pressure spring 420 refer to the portions to which a force is evenly applied (specifically, the portions through which a longitudinal center line of each first pressure spring 420 passes).

Alternatively, the other ends 422*a* of the pair of first pressure springs 420, 420 may be hooked on the fixing roller 171 side of the fixing device 17 (on the main body frame FL of the fixing device 17 in this embodiment), such that the other ends 422*a* are positioned on the imaginary straight line α (α2) (see the dot-dashed line in FIG. 4) in the pressure contact release state where the pressure roller 172 is not pressed against the fixing roller 171, or positioned in an area between the imaginary straight line α (α1) (see the dot-dashed line in FIG. 3 and the broken line in FIG. 4) in the pressure contact state where the pressure roller 172 is pressed against the fixing roller 171 and the imaginary straight line α (α2) (see the dot-dashed line in FIG. 4 and the broken line in FIG. 3) in the pressure contact release state where the pressure roller 172 is not pressed against the fixing roller 171.

According to this arrangement, the pair of first pressure springs 420, 420 receives a less or no force in an unwanted direction. Reduction of a force in an unwanted direction enables smooth movement of the shafts 432 in the guide units 413, and effectively prevents deterioration in durability of the pressure levers 410, the pressure release levers 430, and the first pressure springs 420. This arrangement is particularly effective in the case where the movement directions A are straight directions, as in this embodiment, because deterioration in the efficiency of the spring force due to buckling of the first pressure springs 420 can be prevented.

To be specific, the pressure release levers 430 have through-holes 433 formed along the outer periphery of the shafts 432 (see FIGS. 6A, 6B, and 10), and the main body frame FL of the fixing device 17 is provided with latching parts (specifically, fixing pins) FLa (see FIGS. 3 and 4). In each first pressure spring 420, one end portion 421 including the one end 421*a* is inserted through the through-hole 433 in the pressure release lever 430 and latched on the shaft 432, and the other end portion 422 including the other end 422*a* is latched on the latching part FLa in the main body frame FL.

Further in this embodiment, the retention element 431 of each pressure release lever 430 has a projecting portion 431*a* which projects orthogonally to the movement directions A (orthogonally to the imaginary straight line α in this embodiment) (i.e. which projects in the depth direction X in this embodiment). Each pressure lever 410 is configured to support the shaft 432 of the corresponding pressure release lever 430 at the guide unit 413 in such a manner that the shaft 432 can freely turn about its central axis. Additionally, each pressure lever 410 has a pair of sliding contact portions 415 along which the corresponding projecting portion 431*a* is caused to slide by a biasing force of the corresponding first pressure spring 420 when the corresponding pressure release lever 430 stays between the pressure position Q1 and the release position Q2.

According to this arrangement, when the shafts 432*a* of the pair of pressure release levers 430, 430 reciprocate in the guide units 413 of the pair of pressure levers 410, 410 in the movement directions A (on the imaginary straight line α in this embodiment), the projecting portions 431*a* of the pair of pressure release levers 430, 430 can move smoothly while keeping contact with the sliding contact portions 415 of the pair of pressure levers 410, 410. As a result, it is possible to improve user's operability in the pressure-contact operation or the pressure-release operation.

To be specific, each projecting portion 431*a* (see FIG. 10) is a columnar projecting portion locating at an end of the main body 430*a* of each pressure release lever 430 and projecting from both side faces in the depth direction X. Each of the sliding contact portions 415 (see FIGS. 3 and 4) is composed of a sliding contact surface extending in the depth direction X on a side surface of each pressure lever 410, opposite to the other side surface facing the fixing roller 171.

Further in the pair of pressure levers 410, 410 according to this embodiment, each pair of first retaining parts 412 has a pair of first concave portions 412*a* formed in the pair of sliding contact portions 415. The pair of first concave portions 412*a* is configured to catch the corresponding projecting portion 431*a* when the corresponding pressure release lever 430 stays at the pressure position Q1.

As described above, the first retaining parts 412 of the pair of pressure levers 410, 410 have the first concave portions 412*a* formed in the sliding contact portions 415, and the first concave portions 412*a* are configured to catch the projecting portions 431*a* of the retention elements 431 when the pair of pressure release levers 430, 430 stays at the pressure position Q1. When the pair of pressure release levers 430, 430 stays at the pressure position Q1, this simple configuration allows the projecting portions 431*a* of the pair of pressure release levers 430, 430 to be held in the first concave portions 412*a* of the pair of pressure levers 410, 410 in a stable and reliable manner.

To be specific, the first concave portions 412*a* of the pressure levers 410 have an arc-like (semicircular in this embodiment) curved shape, whose radius of curvature is exactly or approximately the same as the radius r1 of the projecting portions 431*a* of the pressure release levers 430 (see FIG. 10). Hence, the first concave portions 412*a* can securely catch the projecting portions 431*a*, with a greater contact area with the projecting portions 431*a*.

Further in this embodiment, each of the pair of pressure levers 410, 410 is equipped with a pair of second retaining parts 416 for holding the retention element 431 of the corresponding pressure release lever 430 at the release position Q2.

Incidentally, when the pair of pressure release levers 430, 430 stays at the release position Q2, the pair of first pressure springs 420, 420 does not apply a biasing force to the pair of pressure levers 410, 410. Hence, if the projecting portions 431*a* of the retention elements 431 of the pair of pressure release levers 430, 430 are not securely held in the second retaining parts 416 of the pair of pressure levers 410, 410, the pair of first pressure springs 420, 420 may drop off. To prevent this accident, it is necessary to add a member for preventing the pair of first pressure springs 420, 420 from dropping off, which complicates the configuration of the device.

In this regard, each pair of second retaining parts 416 in this embodiment has a pair of second concave portions 416*a* formed in the pair of sliding contact portions 415. The pair of second concave portions 416*a* is configured to catch the projecting portion 431*a* of the retention element 431 when the corresponding pressure release lever 430 stays at the release position Q2.

As described above, the second retaining parts 416 of the pair of pressure levers 410, 410 have the second concave portions 416*a* formed in the sliding contact portions 415, and the second concave portions 416*a* are configured to catch the projecting portions 431*a* of the retention elements 431 when the pair of pressure release levers 430, 430 stays at the release position Q2. When the pair of pressure release levers 430, 430 stays at the release position Q2, this simple configuration allow the projecting portions 431*a* of the pair of pressure release levers 430, 430 to be held in the second concave portions 416*a* of the pair of pressure levers 410, 410 in a reliable manner.

To be specific, each of the second retaining parts 416 is composed of a retaining surface on a side surface of the pressure lever 410, opposite to the other side surface facing the fixing roller 171. The second concave portions 416*a* of the second retaining parts 416 have an arc-like (semicircular in this embodiment) curved shape, whose radius of curvature is exactly or approximately the same as the radius r1 of the projecting portions 431*a* of the pressure release levers 430 (see FIG. 10). Hence, the second concave portions 416*a* can securely catch the projecting portions 431*a*, with a greater contact area with the projecting portions 431*a*.

Relative to the first concave portions 412*a*, the second concave portions 416*a* of the second retaining parts 416 are more distant from (downwardly of, in this embodiment) the rotational supporting points 176*a* and are nearer to the fixing roller 171. The second concave portions 416*a* are provided such that, when the pressure release levers 430 stay at the release position Q2 (see FIG. 4), the axis of the projecting portions 431*a* of the pressure release levers 430 is on the pressure roller 172 side relative to the imaginary straight line $\alpha$ ($\alpha 2$).

In this embodiment, the pair of pressure levers 410, 410 is also provided with sloping convex portions 415*a* in the sliding contact portions 415, between the first concave portions 412*a* and the second concave portions 416*a*.

As a result, when the projecting portions 431*a* of the pair of pressure release levers 430, 430 move between the first concave portions 412*a* and the second concave portions 416*a*, the projecting portions 431*a* can slide along the convex portions 415*a* of the sliding contact portions 415 by a biasing force of the pair of first pressure springs 420, 420. In detail, when the projecting portions 431*a* of the pair of pressure release levers 430, 430 move from the second concave portions 416*a* to the first concave portions 412*a*, the direction of a vector of the pressing force applied to the projecting portions 431*a* changes at the moment when the projecting portions 431*a* pass over the peaks (the top dead centers) of the convex portions 415*a*. Hence, after the projecting portions 431*a* pass over the peaks (the top dead centers) of the convex portions 415*a*, the projecting portions 431*a* are prevented from returning back to the second concave portions 416*a*. Similarly, when the projecting portions 431*a* of the pair of pressure release levers 430, 430 move from the first concave portions 412*a* to the second concave portions 416*a*, the projecting portions 431*a* which have passed over the peaks (the top dead centers) of the convex portions 415*a* are prevented from returning back to the first concave portions 412*a*.

To be specific, in a sliding contact direction in which the projecting portions 431*a* slide along the sliding contact portions 415, one ends of the convex portions 415*a* of the pressure levers 410 are continuous with the first concave portions 412*a*, and other ends thereof are continuous with the second concave portions 416*a*. The convex portions 415*a* are provided nearer to the first concave portions 412*a* (in the vicinity of the first concave portions 412*a*), and a radius of curvature of the convex portions 415*a* is the same as or greater than (slightly greater than) the radius r1 of the projecting portions 431*a* of the pressure release levers 430. Owing to this design, the convex portions 415*a* of the pressure levers 410 can securely keep holding the projecting portions 431*a* of the pressure release levers 430 in the first concave portions 412*a*, and can allow the projecting portions 431*a* to slide along easily between the first concave portions 412*a* and the second concave portions 416*a*.

Incidentally, when the projecting portions 431*a* of the retention elements 431 of the pair of pressure release levers 430, 430 stay in the second concave portions 416*a* of the pair of pressure levers 410, 410, the projecting portions 431*a* may drop off from the second concave portions 416*a* by moving away from the first concave portions 412*a*.

Hence, in this embodiment, each pair of the second concave portions 416*a* is provided with a pair of first regulating portions 415*b* for limiting movement of the projecting portions 431*a* of the retention elements 431 of the pair of pressure release levers 430, 430 in a side opposite to the first concave portions 412*a*.

The presence of the first regulating portions 415*b* can effectively prevent the projecting portions 431*a* of the retention elements 431 of the pair of pressure release levers 430, 430 from dropping off from the second concave portions 416*a* of the pair of pressure levers 410, 410.

To be specific, the pair of first regulating portions 415*b* is formed on a side surface of each guide unit 413 (see FIG. 8), opposite to the side surface where the pair of openings 414*a* is formed. The first regulating portions 415*b* are composed of projections whose one ends are continuous with the second concave portions 416*a*, in a sliding contact direction in which the corresponding projecting portion 431*a* slides along the sliding contact portions 415. Tip ends of the first regulating portions 415*b* project outwardly (toward an opposite side to the corresponding first pressure spring 420) relative to the projecting portion 431*a* of the retention element 431, in a state where each pressure release lever 430 stays at the release position Q2 (see FIG. 4).

Incidentally, when the shafts 432 of the pair of pressure release levers 430, 430 stay in the guide units 413 of the pair of pressure levers 410, 410, the shafts 432 may drop off from the guide units 413 by moving away from the fixing roller 171.

Hence, in this embodiment, each guide unit 413 is provided with a pair of second regulating portions 413*a* for limiting movement of the shaft 432 of the corresponding pressure release lever 430 in a direction away from the fixing roller 171.

The presence of the second regulating portions 413*a* can effectively prevent the shafts 432 of the pair of pressure release levers 430, 430 from dropping off from the guide units 413 of the pair of pressure levers 410, 410.

To be specific, the pair of second regulating portions 413*a* of each guide unit 413 provides regulating surfaces extending in the depth direction X (see FIG. 8). At ends of the pair of guide grooves 414 opposite to the pair of openings 414*a*, one ends of the second regulating portions 413*a* are continuous with the upper second guide surfaces 414*c*, and other ends of the second regulating portions 413*a* are continuous with the lower second guide surfaces 414*c*. These second regulating portions 413*a* can reliably limit movement of the shafts 432 in the pressure release levers 430, 430 in a direction away from the fixing roller 171. In this embodiment, the second regulating portions 413*a* have a semicircular curved shape, curved in the vertical direction Z, whose radius of curvature is exactly or approximately the same as the radius r2 of the shafts 432 of the pressure release levers 430, 430 (see FIG. 10). In other words, the pair of guide grooves 414 and the pair of second regulating portions 413*a* define a pair of U-shaped grooves together.

Further in this embodiment, the pair of first pressure springs 420, 420 has a free length (a natural length) when the pair of pressure release levers 430, 430 stays at the release position Q2 (see FIG. 4).

As described above, since the pair of first pressure springs 420, 420 has a free length when the pair of pressure release levers 430, 430 stays at the release position Q2, the pair of first pressure springs 420, 420 can be attached across the pair of pressure release levers 430, 430 and the fixing roller 171 side of the fixing device, without applying a strong pressure. For example, a worker can manually attach the pair of first pressure springs 420, 420 without a tool. Eventually, this arrangement can enhance efficiency in attaching the pair of first pressure springs 420, 420.

Specifically, the distance between the inner side of the one end 421*a* and the inner side of the other end 422*a* in each first pressure spring 420 is equal or approximately equal to the distance between the outer end of the shaft 432 of each pressure release lever 430 at the release position Q2 and the outer end of each latching part FLa of the main body frame FL (see the distance L in FIG. 4).

Further in this embodiment, the pair of pressure release levers 430, 430 is provided with grips 434 to be held by a user, at an opposite side to the shafts 432 over the retention elements 431.

In this configuration, a user can easily operate the pair of pressure release levers 430, 430 by holding the grips 434. Thus, the grips 434 can enhance user's handleability of the pair of pressure release levers 430, 430.

To be specific, the pressure levers 410 have projecting supports 417 on a side opposite to the fixing roller 171. The projecting supports 417 project in the movement direction A away from the fixing roller 171 and support the cleaning roller 173 for cleaning the surface of the pressure roller 172 (see FIGS. 2-4). The cleaning roller 173 is held by the projecting supports 417 by way of a pair of intermediate supports 175, 175 (see FIGS. 2-4). First ends (lower ends) of the pair of intermediate supports 175, 175 support both ends of the cleaning roller 173 in an axially rotatable manner, whereas other ends (upper ends) thereof are held in support holes 417*a* of the projecting supports 417 and are swingable around a swinging axis extending in the axial direction of the cleaning roller 173. The cleaning roller 173 is pressed against the pressure roller 172 by a biasing member such as a coil spring (not shown). The projecting supports 417 also serve as projecting grips to be held by a user.

At the pressure position Q1, the pressure release levers 430 are configured to be in a parallel orientation in which the grips 434 are parallel or substantially parallel to the movement directions A (see FIG. 3). At the release position Q2, the pressure release levers 430 are configured to be in an inclined orientation in which the grips 434 are inclined in the movement directions A and provide a wider space at the grip-side ends (see FIG. 4). To be more specific, the pressure release levers 430 have their grips 434 inclined at an obtuse angle to the main body 430*a* (see FIG. 10).

As described, since the grips 434 are in a parallel orientation when the pressure release levers 430 stay at the pressure position Q1, a user can easily apply a force to the grips 434, and can easily shift the pressure release levers 430 from the pressure position Q1 to the release position Q2. Besides, since the grips 434 are in an inclined orientation when the pressure release levers 430 stay at the release position Q2, a user can grip one of the projecting supports (projecting grips) 417 projecting in the movement direction A (the direction away from the fixing roller 171) with one hand and can operate one of the grips 434 with the other hand. Thus, a user can also easily shift the pressure release levers 430 from the release position Q2 to the pressure position Q1. The above-described configuration can further enhance user's handleability of the pressure release levers 430.

In each pressure release lever 430, a plurality of ridges 434*a*-434*a* are provided on the surface facing the projecting support (the projecting grip) 417 of the grips 434 and on the surface opposite to the projecting support (the projecting grip) 417 of each grip 434. In the thus configured pressure release levers 430, the ridges 434*a*-434*a* on the grips 434 have a non-slip function for a user holding the grips 434.

Now, referring to an example of performing a fixing operation, if a pouch-like thick recording sheet P (P2, see FIG. 4) such as an envelope is subjected to a fixing operation with a pressure contact force suitable for a standard (plain) recording sheet P (P1, see FIG. 3), the thick recording sheet may suffer from creasing or other transport failures. In order to prevent such a trouble, the fixing device 17 in this embodiment is configured to change the pressure contact force between the fixing roller 171 and the pressure roller 172, between a predetermined first pressure contact force F1 (for example, a pressure contact force for a standard recording sheet, 254.9729 N or 26 kgf in this embodiment, see FIG. 3) and a predetermined second pressure contact force F2 smaller than the first pressure contact force F1 (for example, a pressure contact force for a recording sheet such as an envelope, 6.864655 N or 700 gf in this embodiment, see FIG. 4).

However, in the case where the second pressure contact force F2 (a light load) is so small as to be, for example, only about a fraction (about 1/tenths) of the first pressure contact force F1 (a heavy load) (specifically, if F2 is 6.864655 N or 700 gf and F1 is 254.9729 N or 26 kgf), load setting accuracy of the pair of first pressure springs 420, 420 tends to be worse when applying the light load than the heavy load.

In this respect, the fixing device 17 in this embodiment is further provided with a pair of second pressure springs 450, 450 as an auxiliary biasing member.

When the pair of pressure release levers 430, 430 stays at the pressure position Q1 (see FIG. 3), the pressure contact unit 400 presses the pressure roller 172 against the fixing roller 171 by the pair of first pressure springs 420, 420 with the first pressure contact force F1. When the pair of pressure release levers 430, 430 stays at the release position Q2 (see FIG. 4), the pressure contact unit 400 releases the pressure contact state where the pressure roller 172 is pressed against the fixing roller 171 by the pair of first pressure springs 420, 420, but at the same time presses the pressure roller 172 against the fixing roller 171 by the pair of second pressure springs 450, 450 with the second pressure contact force F2 (<F1). Namely, while the pressure roller 172 is not pressed against the fixing roller 171 by the pair of first pressure springs 420, 420, the pressure contact unit 400 constantly presses the pressure roller 172 against the fixing roller 171 by the pair of second pressure springs 450, 450 with the second pressure contact force F2.

In detail, the pair of pressure levers 410, 410 is provided with latching parts (specifically, attachment holes formed in attachment parts 418) 418*a* on the opposite side to the rotational supporting points 176*a* over the pressure roller 172 in an area surrounding the pressure roller 172 (in the lower left area relative to the pressure roller 172 in the example shown in FIGS. 3 and 4). The main body frame FL of the fixing device 17 is provided with latching parts (specifically, attachment holes) FLb (see FIGS. 3 and 4). First ends 451 of the pair of second pressure springs 450, 450 are hooked on the latching parts 418*a*, and other ends 452 of the pair of second pressure springs 450, 450 are hooked on the main body of the fixing device 17 (specifically, the attachment holes FLb in the main body frame FL).

When a user operates the grips 434 to move the pressure release levers 430 to the pressure position Q1 or the release position Q2 and thereby to stretch or compress the pair of first pressure springs 420, 420 and the pair of second pressure springs 450, 450, the pressure contact unit 400 of the above-described configuration increases or decreases the pressing force for pressing the pressure roller 172 against the fixing roller 171. In other words, when the pair of pressure release levers 430, 430 stays at the pressure position Q1 (see FIG. 3) (when the pressure roller 172 is pressed against the fixing roller 171 by the pair of first pressure springs 420, 420 with the first pressure contact force F1), a user operates the grips 434 to move the pair of pressure release levers 430, 430 to the release position Q2, so that the pressure roller 172 is pressed against the fixing roller 171 by the pair of second pressure springs 450, 450 with the second pressure contact force F2. On the other hand, when the pair of pressure release levers 430, 430 stays at the release position Q2 (see FIG. 4) (when the pressure roller 172 is pressed against the fixing roller 171 by the pair of second pressure springs 450, 450 with the second pressure contact force F2), a user operates the grips 434 to move the pair of pressure release levers 430, 430 to the pressure position Q1, so that the pressure roller 172 is pressed against the fixing roller 171 by the pair of first pressure springs 420, 420 with the first pressure contact force F1.

(Fixing Operation on a Standard Recording Sheet)

For a fixing operation on a standard recording sheet P (P1), the pair of pressure release levers 430, 430 is located at the pressure position Q1 (see FIG. 3), and the pressure roller 172 is pressed against the fixing roller 171 by a biasing force of the pair of first pressure springs 420, 420 with the first pressure contact force F1 (254.9729 N or 26 kgf in this embodiment).

(Fixing Operation on a Thick Recording Sheet Such as an Envelope)

On the other hand, for a fixing operation on a pouch-like thick recording sheet P (P2) such as an envelope, the pair of pressure release levers 430, 430 is located at the release position Q2 (see FIG. 4). At this position, the pair of first pressure springs 420, 420 turns into the pressure contact release state (where the biasing force is zero), and the pair of second pressure springs 450, 450 generates a biasing force for pressing the pressure roller 172 against the fixing roller 171 with the second pressure contact force F2 (specifically, 6.864655 N or 700 gf).

The degree of the second pressure contact force F2, as defined herein, is such that a recording sheet P jammed in the fixing device 17 (so called "paper jam at the fixing unit") can be easily pulled out from between the fixing roller 171 and the pressure roller 172.

In this embodiment, the first fixing member is a fixing roller, and the second fixing member is a pressure roller. Alternatively, the first fixing member may be a pressure roller, and the second fixing member may be a fixing roller. As a further alternative, one of the first fixing member and the second fixing member may be composed of a plurality of rollers including a fixing roller (for example, a fixing roller and a heating roller) and an endless fixing belt looped around the plurality of rollers, and the other one of the first fixing member and the second fixing member may be a pressure roller to be pressed against the fixing roller with an interposition of the fixing belt.

Additionally, the fixing device 17 in this embodiment is configured to turn the pressure levers 410 around the rotational supporting points 176*a*, but may also be configured to move the pressure levers 410 in straight directions for pressing the pressure roller 172 against the fixing roller 171 and releasing the pressure contact state between these rollers (i.e. in straight directions in which the pressure roller 172 approaches and moves away from the fixing roller 171).

Next, as an example of user's operation of the grips 434 of the pair of pressure release levers 430, 430, we mention a case of removing a recording sheet P jammed in the fixing device 17 due to paper jam at the fixing unit, referring to FIGS. 11-15.

Figure 11:
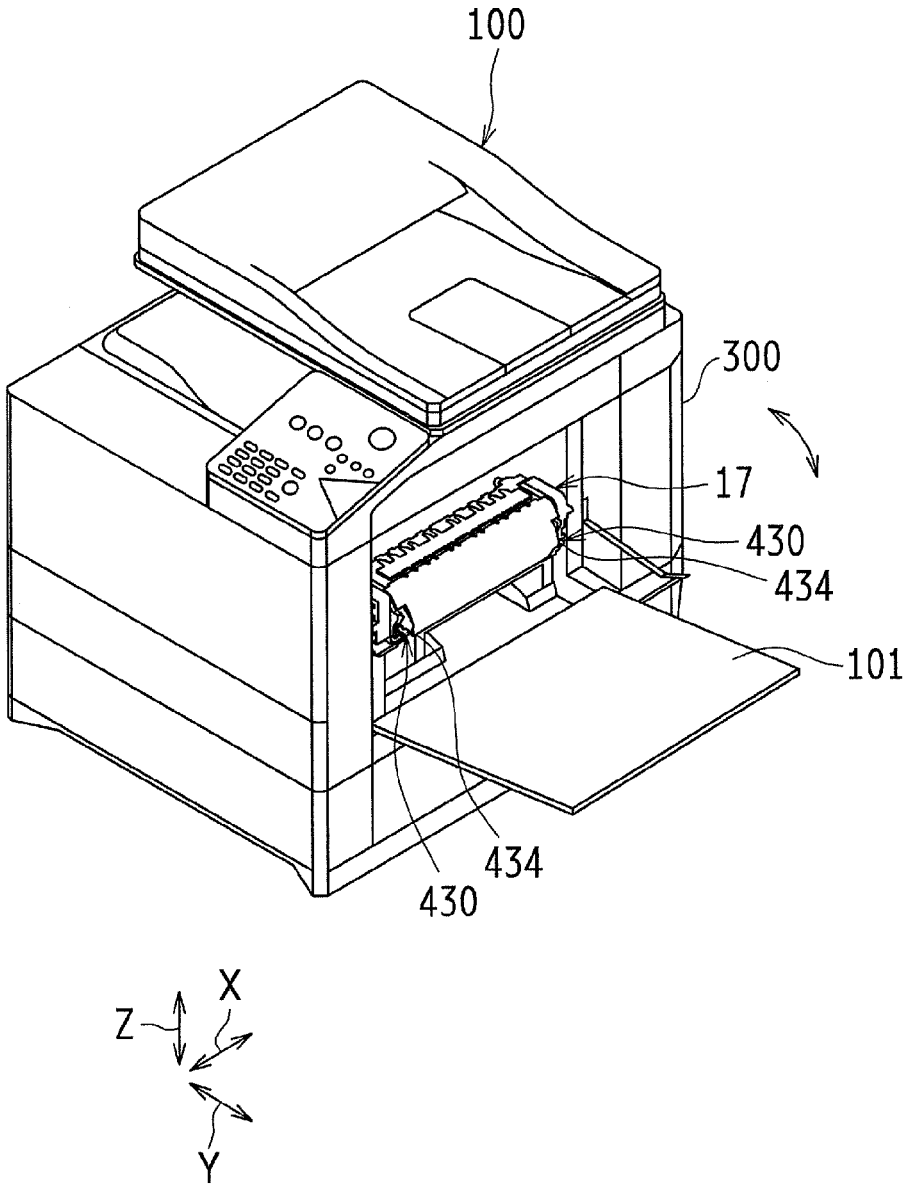
FIG. 11 is a top right perspective view of the image forming apparatus shown in FIG. 1, with a side cover being open.
Figure 12:
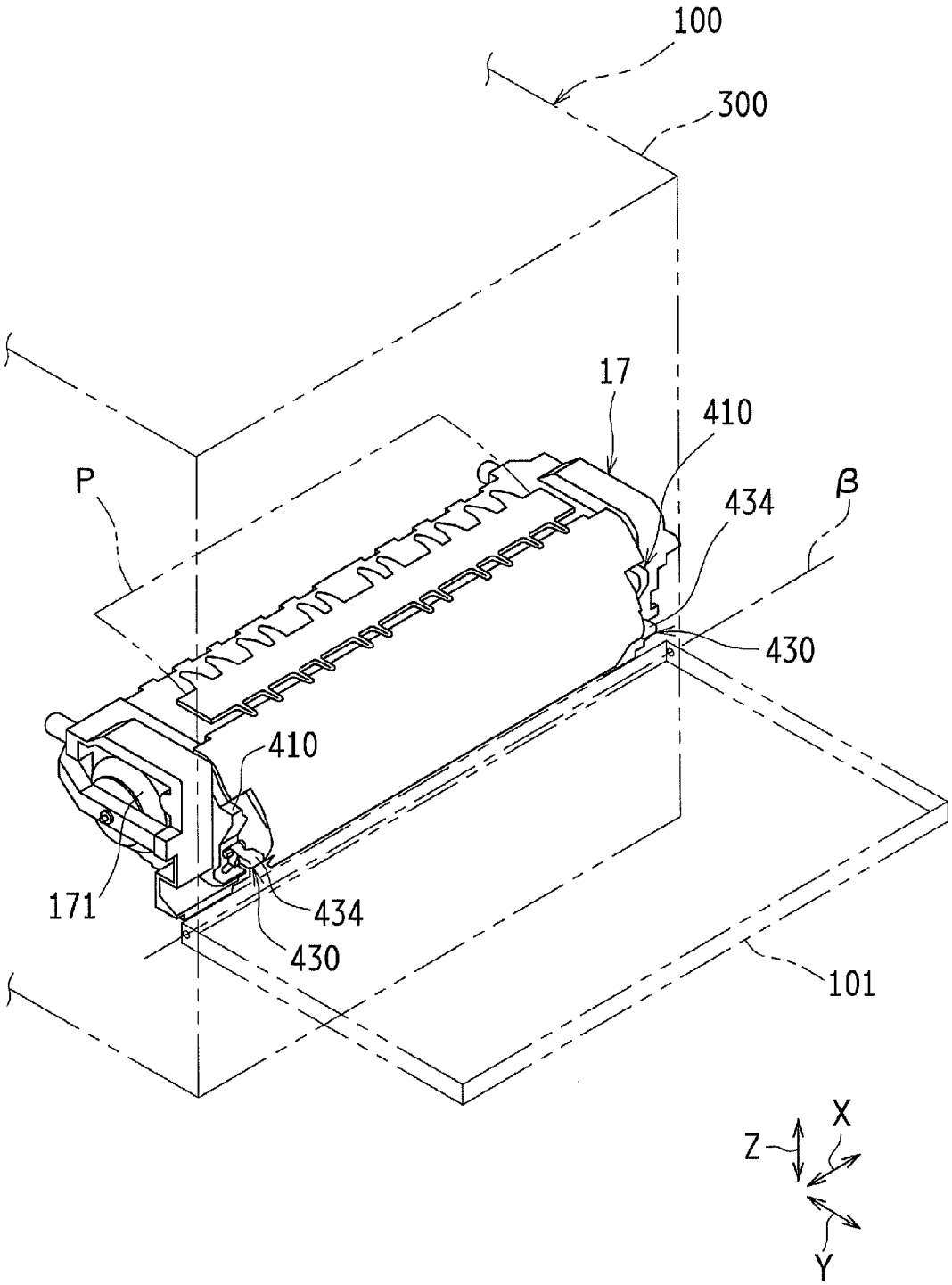
FIG. 12 is an enlarged perspective view of a portion around a fixing device in the image forming apparatus shown in FIG. 11.

FIG. 11 is a top right perspective view of the image forming apparatus 100 shown in FIG. 1, with a side cover 101 being open. FIG. 12 is an enlarged perspective view of a portion around the fixing device 17 in the image forming apparatus 100 shown in FIG. 11.

As shown in FIGS. 11 and 12, the fixing device 17 is mounted in one side (the right face side in this example) of the image forming apparatus 100, with a user operation side (the front face side) of the main body 300 of the image forming apparatus 100 being assumed to be the front side.

The image forming apparatus 100 is also equipped with a side cover 101 provided in a freely opening and closing manner, on the side at which the fixing device 17 is mounted (the right face side in this example).

The fixing device 17 is mounted in the right part of the main body 300 of the image forming apparatus 100, in such a manner that the grips 434 of the pair of pressure release levers 430, 430 are oriented outwardly (oriented to the right face side in this example). Namely, the pair of pressure release levers 430, 430 is provided at the near side and the far side in the depth direction X, with the grip 434 of the near-side pressure release lever 430 and the grip 434 of the far-side pressure release lever 430 being oriented outwardly (oriented to the side cover 101 in this example).

The side cover 101 can freely turn about a rotation axis β (see FIG. 12) that extends in the depth direction X, between a closed position and an open position at which the side cover 101 is closed/opened to the main body 300 of the image forming apparatus 100. At the closed position, the side cover 101 is kept closed (parallel or generally parallel to the side face). At the open position, the side cover 101 opens by about 90° or at least 90° to the face side of the main body 300 of the image forming apparatus 100.

With the fixing device 17 being mounted in the main body 300 of the image forming apparatus 100, the grips 434 of the pair of pressure release levers 430, 430 are oriented outwardly (oriented to the side cover 101 in this example). In the pressure contact state where the pressure roller 172 (not shown in FIGS. 11 and 12, see FIGS. 3, 4, etc.) is pressed against the fixing roller 171 (see FIGS. 12, 3, 4, etc.) with the first pressure contact force F1, if the grips 434 are moved downwardly in the vertical direction Z (specifically, pressed down), the pair of pressure release levers 430, 430 releases this pressure contact state. In the pressure contact released state where the pressure roller 172 is not pressed against the fixing roller 171 with the first pressure contact force F1, if the grips 434 are moved upwardly in the vertical direction Z (specifically, pushed up), the pair of pressure release levers 430, 430 causes the pressure roller 172 to be pressed against the fixing roller 171 with the first pressure contact force F1. In this manner, a user can easily perform the pressure-release operation for releasing the pressure contact state where the pressure roller 172 is pressed against the fixing roller 171 with the first pressure contact force F1, and can also easily perform the pressure-contact operation for pressing the pressure roller 172 against the fixing roller 171 with the first pressure contact force F1.

In the image forming apparatus 100 of the above configuration, paper jam at the fixing unit is detected by a sheet detection sensor (not shown) provided downstream (in the sheet conveying direction) of the fixing nip region N between the fixing roller 171 and the pressure roller 172 (see FIGS. 3 and 4). Specifically, if the sheet detection sensor does not detect a leading edge of a recording sheet P (a downstream edge in the sheet conveying direction) or a trailing edge of a recording sheet P (an upstream edge in the sheet conveying direction) within a given time after a preset timing, the sheet detection sensor confirms paper jam at the fixing unit. If paper jam is detected at the fixing unit, the image forming apparatus 100 stops an image forming operation (a printing operation) in the main body 300 and presents an indication (so-called paper jam indication) on a display (not shown) provided at an operation side of the main body 300 so as to inform a user of the paper jam at the fixing unit. From this indication, a user can notice the paper jam at the fixing unit.

A user who noticed paper jam at the fixing unit opens the side cover 101 from the closed position to the open position, thereby exposing the grips 434 of the pair of pressure release levers 430, 430 in the fixing device 17 that is mounted in the main body 300. In this state, the pressure roller 172 is pressed against the fixing roller 171 with the first pressure contact force F1. If the user performs a pressure-release operation (a press-down operation) by pressing the grips 434 of the pair of pressure release levers 430, 430 downwardly in the vertical direction Z, the pressure contact state where the pressure roller 172 is pressed against the fixing roller 171 with the first pressure contact force F1 is released. Once the pressure contact state is released, the user can easily remove a recording sheet P (a jammed sheet) stuck at the fixing nip region N between the fixing roller 171 and the pressure roller 172.

After the user has removed the recording sheet P (the jammed sheet) easily, the pressure contact released state where the pressure roller 172 is not pressed against the fixing roller 171 with the first pressure contact force F1 is still maintained. If the user performs a pressure-contact operation (a push-up operation) by pushing up the grips 434 of the pair of pressure release levers 430, 430 upwardly in the vertical direction Z, the pressure roller 172 is pressed against the fixing roller 171 with the first pressure contact force F1. Thereafter, the user closes the side cover from the open position in such a manner as to keep the closed position, and a normal printing operation can be resumed in the main body 300.

In this respect, the user receives an initial load not only when the user starts to move the grips 434 in the pressure-release operation (the press-down operation) of the grips 434 of the pair of pressure release levers 430, 430 (at an initial stage of the pressure-release/press-down operation), but also when the user starts to move the grips 434 in the pressure-contact operation (the push-up operation) of the grips 434 of the pair of pressure release levers 430, 430 (at an initial stage of the pressure-contact/push-up operation). In this embodiment, the initial load in the pressure-release operation (the press-down operation) is set greater than the initial load in the pressure-contact operation (the push-up operation).

To be specific, as apparent from the shape of the sloping convex portions 415*a* in the sliding contact portions 415 between the first concave portions 412*a* and the second concave portions 416*a* (see FIGS. 3, 4, etc.), the slope angle of the sloping surfaces from the first concave portions 412*a* to the convex portions 415*a* to be traveled at the start of the pressure-release operation (the press-down operation) is greater than the slope angle of the sloping surfaces from the second concave portions 416*a* to the convex portions 415*a* to be traveled at the start of the pressure-contact operation (the push-up operation). Hence, the user receives a greater initial load at the start of the pressure-release operation (the press-down operation) than at the start of the pressure-contact operation (the push-up operation). Owing to this arrangement, even when an unexpected external force acts downwardly on the grips 434 of the pair of pressure release levers 430, 430, the pressure contact state where the pressure roller 172 is pressed against the fixing roller 171 with the first pressure contact force F1 is not released easily. Namely, this arrangement prevents the pressure contact state where the pressure roller 172 is pressed against the fixing roller 171 with the first pressure contact force F1 from being released by an unexpected external force acting on the grips 434 of the pair of pressure release levers 430, 430, but this arrangement still allows a user to apply a greater force in the pressure-release operation (the press-down operation) than in the pressure-contact operation (the push-up operation) and to perform the pressure-release operation (the press-down operation) without trouble.

On the other hand, since the initial load applied to the user at the start of the pressure-contact operation (the push-up operation) is smaller than the initial load applied to the user at the start of the pressure-release operation (the press-down operation), a user can easily perform the pressure-contact operation (the push-up operation).

Figure 13:
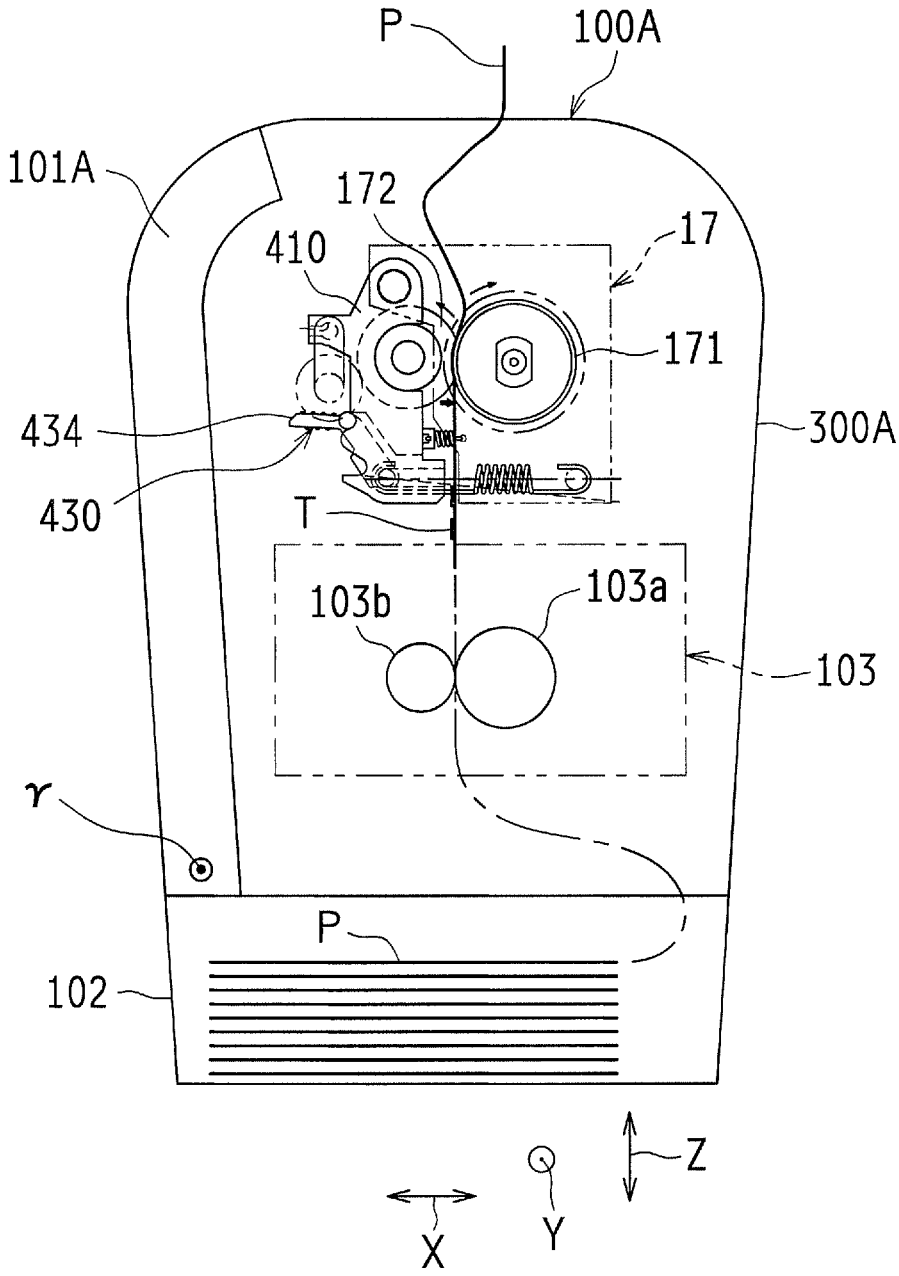
FIG. 13 is a side view showing a schematic configuration of another image forming apparatus, in which the fixing device is mounted such that grips of the pressure release levers are oriented to a user operation side (a front face side) of the main body.
Figure 14:
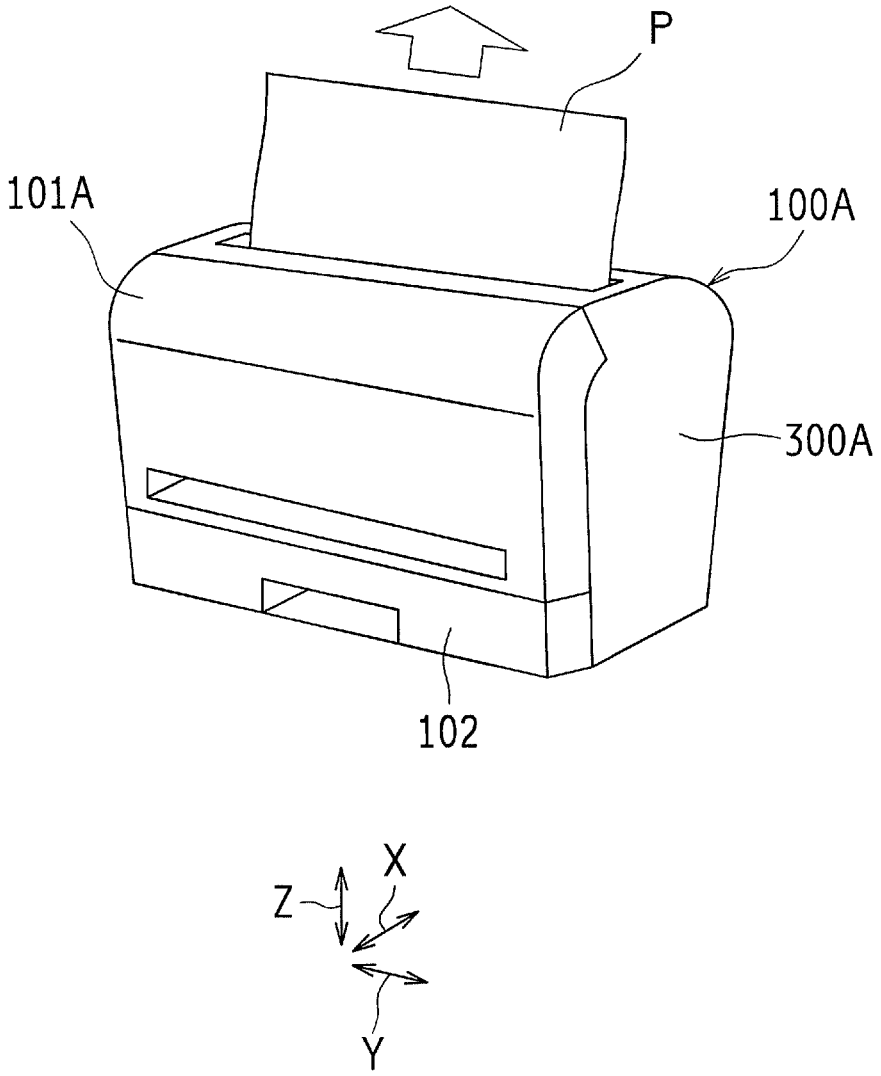
FIG. 14 is a top right perspective view showing a schematic configuration of the image forming apparatus shown in FIG. 13.
Figure 15:
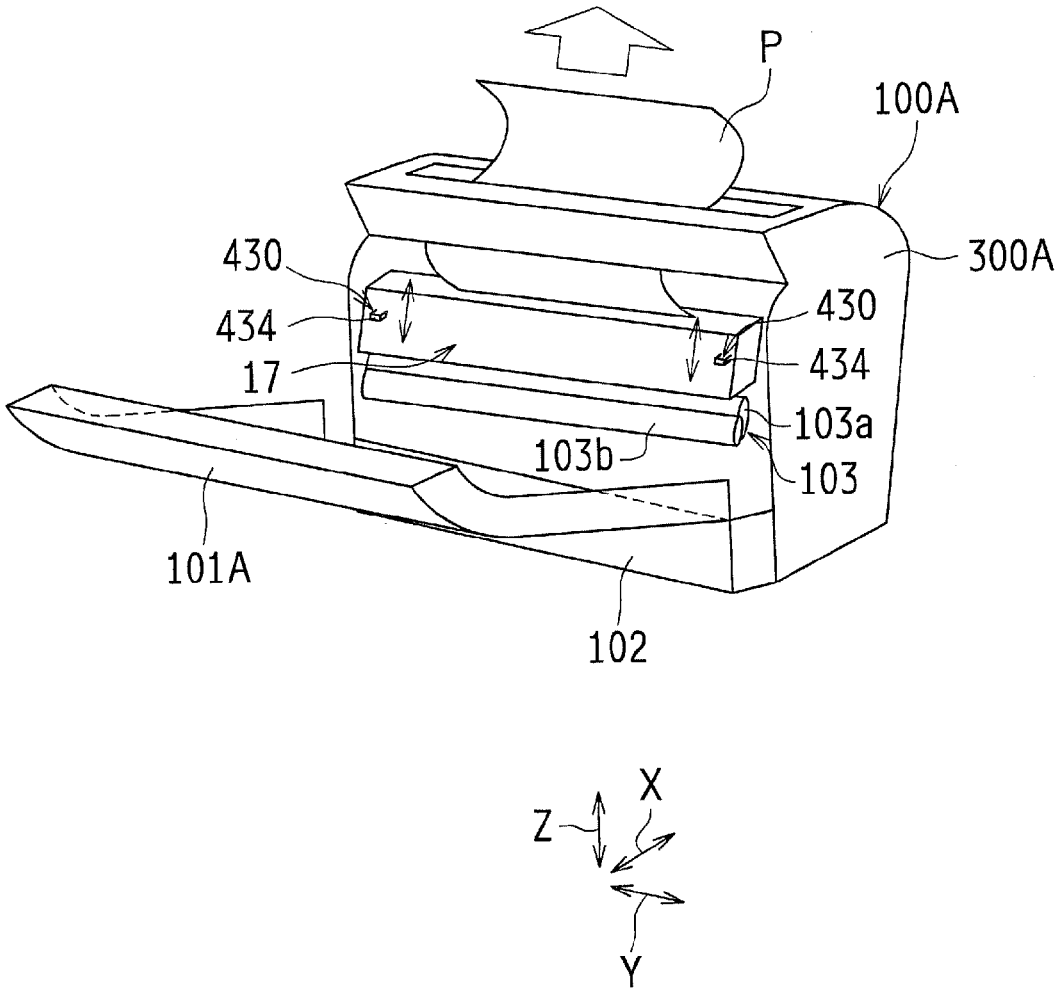
FIG. 15 is a perspective view of the image forming apparatus shown in FIG. 13, with a front cover being open.

FIG. 13 is a side view showing a schematic configuration of another image forming apparatus 100A, in which the fixing device 17 is mounted such that the grips 434 of the pressure release levers 430 are oriented to a user operation side (a front face side) of the main body 300A. FIG. 14 is a top right perspective view showing a schematic configuration of the image forming apparatus 100A shown in FIG. 13. FIG. 15 is a perspective view of the image forming apparatus 100A shown in FIG. 13, with a front cover 101A being open.

The image forming apparatus 100A is equipped with a sheet feeding unit 102, an image forming unit 103, and a fixing device 17 according to this embodiment.

The sheet feeding unit 102 is provided at a lower part of the main body 300A in the image forming apparatus 100A, and feeds recording sheets P to the image forming unit 103. The image forming unit 103, provided above the sheet feeding unit 102, is equipped with a photosensitive drum 103*a*, a transfer roller 103*b*, and additional elements (not shown) for performing an image forming (printing) operation, such as an electrostatic charger, an exposure unit, a developing unit, and a cleaning unit. The configurations and operations of the sheet feeding unit 102 and the image forming unit 103 are similar to those of the conventional units, and detailed descriptions thereof are omitted.

The fixing device 17, mounted above the image forming unit 103, fixes toner T (an unfixed image) on a recording sheet P supplied from the image forming unit 103, while conveying the recording sheet P upwardly.

In the image forming apparatus 100A having this configuration, an image is formed on the recording sheet P supplied from the sheet feeding unit 102, and the image is fixed thereon in the fixing device 17. Thereafter, the recording sheet P is discharged to the outside from a top face of the main body 300A of the image forming apparatus 100A.

The image forming apparatus 100A is also equipped with a front cover 101A provided in a freely opening and closing manner, on a user operation side (a front face side) of the main body 300A.

The fixing device 17 is mounted in an upper part of the main body 300A of the image forming apparatus 100A, in such a manner that the grips 434 of the pair of pressure release levers 430, 430 are oriented outwardly (oriented to the front face side in this example). Namely, the pair of pressure release levers 430, 430 is located at the right side and the left side in the width direction Y, with the grip 434 of the right-side pressure release lever 430 and the grip 434 of the left-side pressure release lever 430 being oriented outwardly (oriented to the front cover 101A in this example).

The front cover 101A can freely turn about a rotation axis γ (see FIG. 13) that extends in the width direction Y, between a closed position and an open position at which the front cover 101A is closed/opened to the main body 300A of the image forming apparatus 100A. At the closed position, the front cover 101A is kept closed (parallel or generally parallel to the front face). At the open position, the front cover 101A opens by about 90° or at least 90° to the front face of the main body 300A of the image forming apparatus 100A.

With the fixing device 17 being mounted in the main body 300A of the image forming apparatus 100A, the grips 434 of the pair of pressure release levers 430, 430 are oriented outwardly (oriented to the front cover 101A in this example). In the pressure contact state where the pressure roller 172 is pressed against the fixing roller 171 with the first pressure contact force F1, if the grips 434 are moved downwardly in the vertical direction Z (specifically, pressed down), the pair of pressure release levers 430, 430 releases this pressure contact state. In the pressure contact released state where the pressure roller 172 is not pressed against the fixing roller 171 with the first pressure contact force F1, if the grips 434 are moved upwardly in the vertical direction Z (specifically, pushed up), the pair of pressure release levers 430, 430 causes the pressure roller 172 to be pressed against the fixing roller 171 with the first pressure contact force F1. In this manner, a user can easily perform the pressure-release operation for releasing the pressure contact state where the pressure roller 172 is pressed against the fixing roller 171 with the first pressure contact force F1, and can also easily perform the pressure-contact operation for pressing the pressure roller 172 against the fixing roller 171 with the first pressure contact force F1.

Other arrangements, such as detection of paper jam at the fixing unit and operations of the pair of pressure release levers 430, 430, are similar to those described with reference to FIGS. 11 and 12, and detailed descriptions thereof are omitted.

The present invention should not be limited to the above-described embodiments but may be embodied in other specific forms. The above-described examples are therefore to be considered in all respects as illustrative and not restrictive, the scope of the invention being indicated by the appended claims rather than by the foregoing description. Further, all changes which come within the meaning and range of equivalency of the claims are therefore intended to be embraced therein.

What is claimed is:

1. A fixing device comprising:

a first fixing member;

a second fixing member opposed to the first fixing member;

a support member which supports the second fixing member such that the second fixing member can approach and separate from the first fixing member;

a biasing member which biases the support member such that the second fixing member is pressed against the first fixing member; and a pressure release member which releases a pressure contact state where the second fixing member is pressed against the first fixing member, wherein the fixing device is configured to move the pressure release member in predetermined movement directions relative to the support member such that the biasing member can function, the movement directions being set in advance, the support member comprises a first retaining part for retaining the pressure release member at a pressure position in the movement directions at which position the biasing member functions, the pressure release member comprises a retention element to be held in the first retaining part of the support member, when the retention element is held in the first retaining part of the support member, the pressure release member is configured to apply a biasing force of the biasing member to the support member and thereby to cause the second fixing member to be pressed against the first fixing member, and when the retention element is released from the first retaining part of the support member, the pressure release member is configured to stay at a release position in the movement directions at which position the biasing member ceases to apply the biasing force to the support member, and thereby to release the pressure contact state where the second fixing member is pressed against the first fixing member, wherein the pressure release member comprises a shaft extending in an orthogonal direction that is orthogonal to the movement directions, and the support member comprises a guide unit which supports the shaft of the pressure release member reciprocably in the movement directions.

2. The fixing device according to claim 1, wherein the guide unit has a guide groove which guides the shaft of the pressure release member in a freely movable manner in the movement directions, and the guide groove has an opening which is open to an outside and through which the shaft of the pressure release member is attachably and detachably inserted.

3. The fixing device according to claim 1, wherein the biasing member has one end thereof located on the shaft of the pressure release member, and has the other end thereof located on a support member for supporting the first fixing member, the other end of the biasing member being positioned on a first imaginary straight line extending in the movement directions in the pressure contact state where the second fixing member is pressed against the first fixing member, on a second imaginary straight line in a pressure contact release state where the second fixing member is not pressed against the first fixing member, or in an area between the first imaginary straight line in the pressure contact state where the second fixing member is pressed against the first fixing member and the second imaginary straight line in the pressure contact release state where the second fixing member is not pressed against the first fixing member.

4. The fixing device according to claim 1, wherein the retention element of the pressure release member comprises a projecting portion which projects in the orthogonal direction that is orthogonal to the movement directions, the support member is configured to support the shaft of the pressure release member at the guide unit in such a manner that the shaft of the pressure release member can freely turn about a central axis of the shaft, and the support member comprises a sliding contact portion along which the projecting portion is caused to slide by the biasing force of the biasing member when the pressure release member stays between the pressure position and the release position.

5. The fixing device according to claim 4, wherein the first retaining part of the support member has a first concave portion formed in the sliding contact portion, and the first concave portion is configured to catch the projecting portion of the retention element when the pressure release member stays at the pressure position.

6. The fixing device according to claim 5, wherein the support member comprises a second retaining part which holds the retention element of the pressure release member at the release position, the second retaining part has a second concave portion formed in the sliding contact portion, and the second concave portion is configured to catch the projecting portion of the retention element when the pressure release member stays at the release position.

7. The fixing device according to claim 6, wherein the support member is provided with a sloping convex portion in the sliding contact portion between the first concave portion and the second concave portion.

8. The fixing device according to claim 6, wherein the second concave portion is provided with a first regulating portion which limits movement of the projecting portion of the retention element of the pressure release member in a side opposite to the first concave portion.

9. The fixing device according to claim 1, wherein the guide unit is provided with a second regulating portion which limits movement of the shaft of the pressure release member in a direction away from the first fixing member.

10. The fixing device according to claim 1, wherein the biasing member has a free length when the pressure release member stays at the release position.

11. An image forming apparatus comprising the fixing device according to claim 1.

12. The image forming apparatus according to claim 11, wherein the pressure release member comprises a grip which is oriented outwardly in a condition where the fixing device is mounted in the image forming apparatus, in the pressure contact state where the second fixing member is pressed against the first fixing member, downward movement of the grip allows the pressure release member to release the pressure contact state, and in the pressure contact released state where the second fixing member is not pressed against the first fixing member, upward movement of the grip allows the pressure release member to press the second fixing member against the first fixing member.

* * * * *